US011098546B2

(12) United States Patent
Varkey et al.

(10) Patent No.: US 11,098,546 B2
(45) Date of Patent: Aug. 24, 2021

(54) SYSTEMS AND METHODS FOR HOLDING WIRELINE DEVICE AGAINST WELL

(71) Applicant: Schlumberger Technology Corporation, Sugar Land, TX (US)

(72) Inventors: Joseph Varkey, Richmond, TX (US); Maria Grisanti, Missouri City, TX (US); Paul Wanjau, Missouri City, TX (US); David Kim, Katy, TX (US); William Brian Underhill, Richmond, TX (US); Nicolas Roumilly, Clamart (FR); Sebastien Isambert, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 24 days.

(21) Appl. No.: 16/587,098

(22) Filed: Sep. 30, 2019

(65) Prior Publication Data

US 2020/0024920 A1 Jan. 23, 2020

Related U.S. Application Data

(63) Continuation-in-part of application No. 15/392,193, filed on Dec. 28, 2016, now Pat. No. 10,472,910.

(51) Int. Cl.

| | |
|---|---|
| ***E21B 23/14*** | (2006.01) |
| ***E21B 23/01*** | (2006.01) |
| ***E21B 49/00*** | (2006.01) |
| ***E21B 17/00*** | (2006.01) |
| ***E21B 17/10*** | (2006.01) |
| *E21B 23/00* | (2006.01) |

(52) U.S. Cl.

CPC ..... *E21B 23/14* (2013.01); *E21B 17/003* (2013.01); *E21B 17/1014* (2013.01); *E21B 23/01* (2013.01); *E21B 49/00* (2013.01); *E21B 23/001* (2020.05)

(58) Field of Classification Search

CPC ..... E21B 23/14; E21B 23/01; E21B 49/00; E21B 17/003; E21B 17/1014; E21B 23/001; E21B 47/09

See application file for complete search history.

(56) References Cited

U.S. PATENT DOCUMENTS

| | | | | |
|---|---|---|---|---|
| 3,233,170 A * | 2/1966 | Rogers | E21B 47/09 | 324/226 |
| 4,438,810 A * | 3/1984 | Wilkinson | E21B 23/14 | 166/55.1 |
| 4,515,010 A * | 5/1985 | Weido | E21B 47/09 | 166/255.1 |
| 4,953,136 A * | 8/1990 | Kamata | G01V 1/16 | 367/25 |
| 5,259,452 A * | 11/1993 | Wittrisch | E21B 23/01 | 166/250.01 |

(Continued)

OTHER PUBLICATIONS

Notice of Allowance issued in U.S. Appl. No. 16/679,366, dated Jan. 1, 2021 (12 pages).

*Primary Examiner* — Michael R Wills, III

(57) ABSTRACT

A system includes a cable and at least one coupling device installed along the cable. The coupling element has one or more through cavities for receiving the cable, and configured to hold the cable when disposed in the cavity against a surface of the wellbore.

20 Claims, 21 Drawing Sheets

(56) References Cited

U.S. PATENT DOCUMENTS

| | | | | |
|---|---|---|---|---|
| 6,006,855 | A * | 12/1999 | Howlett | G01V 1/52 181/102 |
| 6,026,911 | A | 2/2000 | Angle et al. | |
| 7,187,620 | B2 * | 3/2007 | Nutt | G01V 1/40 166/66 |
| 7,721,809 | B2 * | 5/2010 | Minto | G01V 1/52 166/381 |
| 7,894,297 | B2 * | 2/2011 | Nutt | G01V 11/002 367/25 |
| 9,170,149 | B2 | 10/2015 | Hartog et al. | |
| 9,217,320 | B2 * | 12/2015 | Odashima | B05B 5/081 |
| 2014/0191762 | A1 | 7/2014 | Chen et al. | |
| 2016/0215579 | A1 | 7/2016 | Van Der Ende | |
| 2017/0285208 | A1 * | 10/2017 | Castillo | G01V 3/08 |
| 2018/0179840 | A1 | 6/2018 | Varkey et al. | |
| 2020/0110235 | A1 | 4/2020 | Maida et al. | |

* cited by examiner

SYSTEMS AND METHODS FOR HOLDING WIRELINE DEVICE AGAINST WELL

BACKGROUND

This disclosure relates to systems and methods to improve a signal to noise ratio of wellbore measurements, in particular distributed acoustic sensing measurement.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, these statements are to be read in this light, and not as admissions of any kind.

To locate and extract resources from a well, a wellbore may be drilled into a geological formation. Some wellbores may change direction at some point downhole. The change in direction may be at an angle as high as ninety degrees with respect to the surface, causing the wellbore to become horizontal. Downhole toolstrings and sensors are placed into the wellbore to identify properties of the downhole environment. The cable may also comprise a fiber optic line that enables to provide distributed acoustic sensing. In vertical portions of the wellbore, the downhole toolstrings and sensors may descend into the wellbore using only the force of gravity. However, the downhole toolstrings and sensors may descend into angled portions of the well through the use of additional forces other than gravity. As the wellbore approaches a more horizontal angle, the additional forces play a greater role in propelling the downhole toolstrings and sensors deeper into the wellbore. Once the downhole toolstrings and sensors reach the desired location within the wellbore, the sensors are used to gather data about the geological formation. However, this movement of the toolstrings and sensors may worsen the signal to noise ratio, which could lead to less accurate measurements. In case where a fiber optic is included in the cable, the placement of the cable along the wellbore may have an influence on the signal to noise ratio of the distributed acoustic measurements.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The disclosure generally relates to a system comprising a cable and at least one coupling device installed along the cable having one or more through cavities for receiving the cable, and configured to hold the cable when disposed in the cavity against a surface of the wellbore. Such coupling device may hold the cable against the surface of the wellbore in a cased hole and/or open hole configuration. This can lead to more accurate measurements and decrease the signal to noise ratio. Such coupling is particularly interesting when the cable includes fiber optic, for instance when the cable is a wireline cable includes a fiber optic cable. The fiber being coupled to the wellbore, the signal obtained from the formation are better sensed and the signal to noise ratio is improved, enabling to get better insight of the formation characteristics.

The disclosure also related to a method for operating a cable in a wellbore. The method includes installing one or more coupling devices along the cable, so that the cable is received in one or more through cavities of the coupling devices, lowering the cable with the installed coupling device into the wellbore, wherein the coupling device holds the cable disposed in the cavity against a surface of the wellbore.

In one example, a system includes a cable, a toolstring, and a device. The toolstring may couple to the cable to enable the toolstring to be placed in a wellbore. Further, the toolstring includes sensors configured to collect data of a geological formation. The device may selectively hold the toolstring against a surface of the wellbore.

In another example, a cable system includes a cable core that includes fiber optic cables, multiple strength members outside of the cable core, and multiple magnetic strength members outside of the cable core. The multiple magnetic strength members may selectively carry current, and the multiple magnetic strength members may become magnetic or activate an electromagnet electrically coupled to the multiple magnetic strength members when the multiple magnetic strength members carry current.

In yet another example, a method for improving the signal to noise ratio, includes lowering a cable and a toolstring into a wellbore. The method includes extending at least one arm of a tractor device coupled to the toolstring, and the at least one arm includes a wheel. The method includes engaging the wheel of the tractor device against a surface of the wellbore, and engaging the wheel of the tractor device propels the toolstring and the cable into the wellbore. The method includes retracting the at least one arm of the tractor device, and retracting the at least one arm disengages the wheel from the surface of the wellbore. The method includes attaching the toolstring to the surface of the wellbore using a device coupled to the toolstring.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1A:
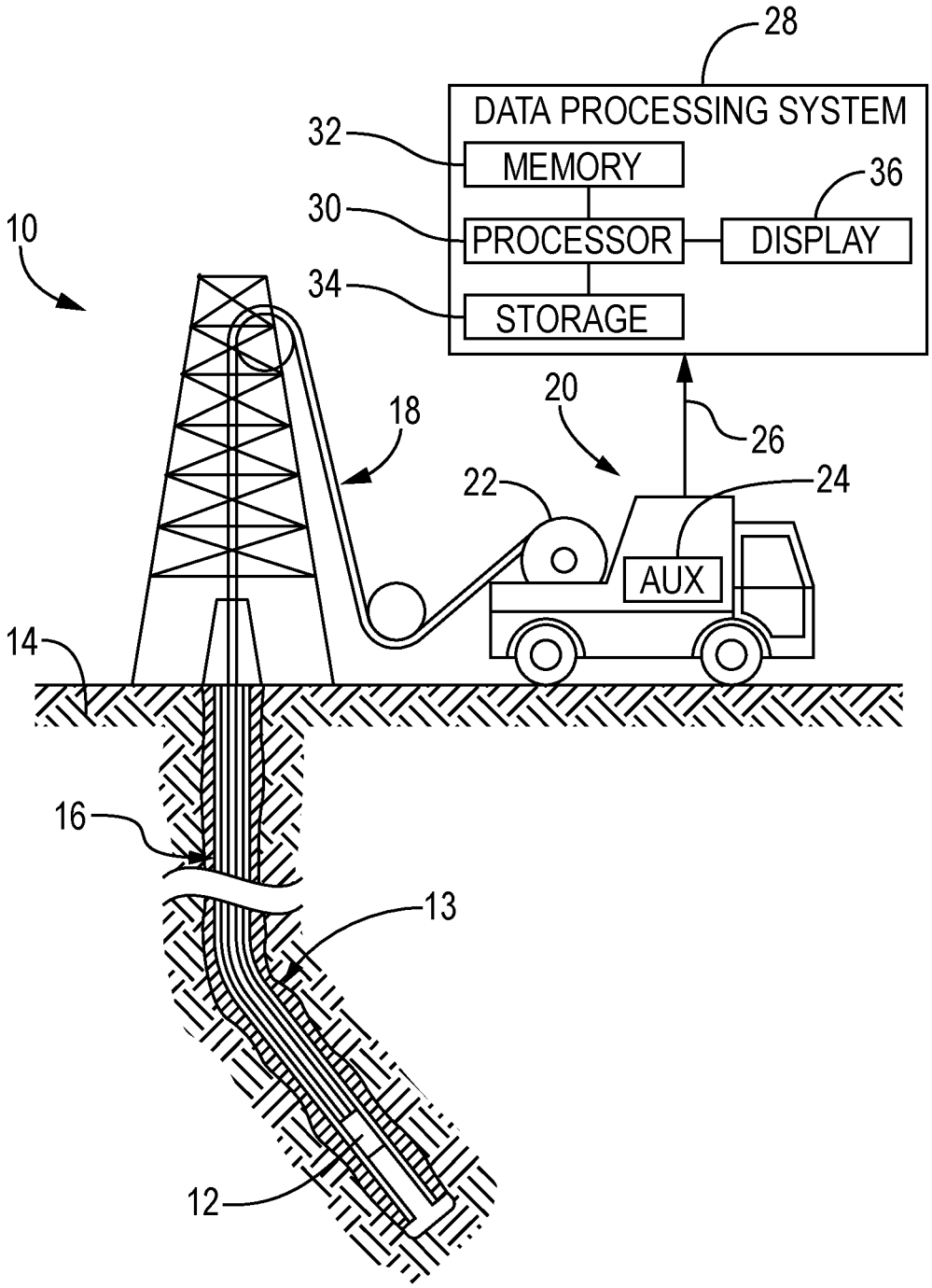
FIG. 1A is a schematic diagram of a wireline system that includes a toolstring to detect properties of a wellbore or geological formation adjacent to the toolstring, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates to devices that improve the signal to noise ratio of sensors in a wellbore. Toolstrings containing sensors may be placed into the wellbore to gather information about the geological formation. In some portions of the wellbore, the tool may require forces in addition to gravity to descend further into the well. Once the tool has reached the desired location in the wellbore, the sensors may gather data about the geological formation. When the sensors are gathering data, movement of the sensors may worsen the signal to noise ratio. Therefore, it is desirable to keep the sensors as steady as is possible when the sensors are gathering data.

Accordingly, embodiments of this disclosure relate to a system and method for propelling the toolstring further into the wellbore and for holding the toolstring in a steady position once the toolstring has reached the desired location. That is, some embodiments include a tractor device that includes extendable arms. The arms include drive wheels that may engage the surface of the casing of the wellbore and propel the toolstring further into the wellbore. Some embodiments include a device that may hold the toolstring steady at the desired location in the wellbore. The device may include components within a cable that can be selectively magnetized. When the components are activated and the components becomes magnetized, the cable may attach to the casing of the wellbore. Attaching the cable to the casing of the wellbore may hold the toolstring steady in place. Alternatively, the device may include components within the toolstring that can be selectively magnetized. When the components are activated and the components become magnetized, the toolstring may attach and hold steady against the casing of the wellbore. Alternatively, the device may include components that mechanically hold the toolstring against the casing of the wellbore. The components may include an arm that braces the toolstring against the casing of the wellbore. Further, the device may include multiple devices spread out along the cable.

With this in mind, FIG. 1A illustrates a well-logging system 10 that may employ the systems and methods of this disclosure. The well-logging system 10 may be used to convey a toolstring 12 through a geological formation 14 via a wellbore 16. Further, the wellbore 16 may not continue straight down into the geological formation 14, and the wellbore 16 may contain a turn 13. The wellbore 16 may continue past the turn into the geological formation 14 at an angle as high as ninety degrees. In the example of FIG. 1A, the toolstring 12 is conveyed on a cable 18 via a logging winch system (e.g., vehicle) 20. Although the logging winch system 20 is schematically shown in FIG. 1A as a mobile logging winch system carried by a truck, the logging winch system 20 may be substantially fixed (e.g., a long-term installation that is substantially permanent or modular). Any suitable cable 18 for well logging may be used. The cable 18 may be spooled and unspooled on a drum 22 and an auxiliary power source 24 may provide energy to the logging winch system 20, the cable 18, and/or the toolstring 12.

Moreover, while the toolstring 12 is described as a wireline toolstring, it should be appreciated that any suitable conveyance may be used. For example, the toolstring 12 may instead be conveyed as a logging-while-drilling (LWD) tool as part of a bottom hole assembly (BHA) of a drill string, conveyed on a slickline or via coiled tubing, and so forth. For the purposes of this disclosure, the toolstring 12 may include any suitable measurement tool that uses a sensor to obtain measurements of properties of the geological formation 14. The toolstring 12 may use any suitable sensors to obtain any suitable measurement, including resistivity measurements, electromagnetic measurements, radiation-based (e.g., neutron, gamma-ray, or x-ray) measurements, acoustic measurements, and so forth. In general, the toolstring 12 may obtain better measurements, having a higher signal-to-noise ration, when the toolstring 12 is pressed against the wellbore 16 wall. In some cases, the toolstring 12 may use fiber optic sensors that obtain wellbore measurements that are greatly improved when the toolstring 12 is pressed against the wellbore 16 wall. Furthermore, when the cable 18 includes fiber optic cables, the signal that is transported over the fiber optic cables may be improved when the cable is generally held taut (rather than, for example, including many turns or kinks that could degrade the signal traveling over the fiber optic cable).

The toolstring 12 may emit energy into the geological formation 14, which may enable measurements to be obtained by the toolstring 12 as data 26 relating to the wellbore 16 and/or the geological formation 14. When collecting the data 26, it is desirable to keep the toolstring 12 as steady as possible in order to improve the signal to noise ratio. Improving the signal to noise ratio allows for more accurate readings. The data 26 may be sent to a data processing system 28. For example, the data processing system 28 may include a processor 30, which may execute instructions stored in memory 32 and/or storage 34. As such, the memory 32 and/or the storage 34 of the data processing system 28 may be any suitable article of manufacture that can store the instructions. The memory 32 and/or the storage 34 may be read-only memory (ROM), random-access memory (RAM), flash memory, an optical storage medium, or a hard disk drive, to name a few examples. A display 36, which may be any suitable electronic display, may display the images generated by the processor 30. The data processing system 28 may be a local component of the logging winch system 20 (e.g., within the toolstring 12), a remote device that analyzes data from other logging winch systems 20, a device located proximate to the drilling operation, or any combination thereof. In some embodiments, the data processing system 28 may be a mobile computing device (e.g., tablet, smart phone, or laptop) or a server remote from the logging winch system 20.

In another embodiment, the cable 18 including fiber optic cables (i.e. optical fiber) may also be used for measuring one or more parameters of the wellbore 16 or formation 14, using distributed techniques. Such measurement is well known as distributed temperature sensing (DTS), in which the sensed parameter is temperature, or distributed acoustic sensing (DAS), in which the sensed parameters includes acoustic waves. DAS is more particularly used to sense the properties of the formation, generally in combination with acoustic sources generating a predetermined acoustic signal, such as seismic sources disposed at the surface, the signal passing through the formation and being received at one or more location of the fiber optic enabling to derive very useful information about the formation properties. In order to have a better transmission of information from the formation to the fiber, having the fiber, and therefore the cable, as close to the borehole wall as possible is very valuable.

Figure 1B:
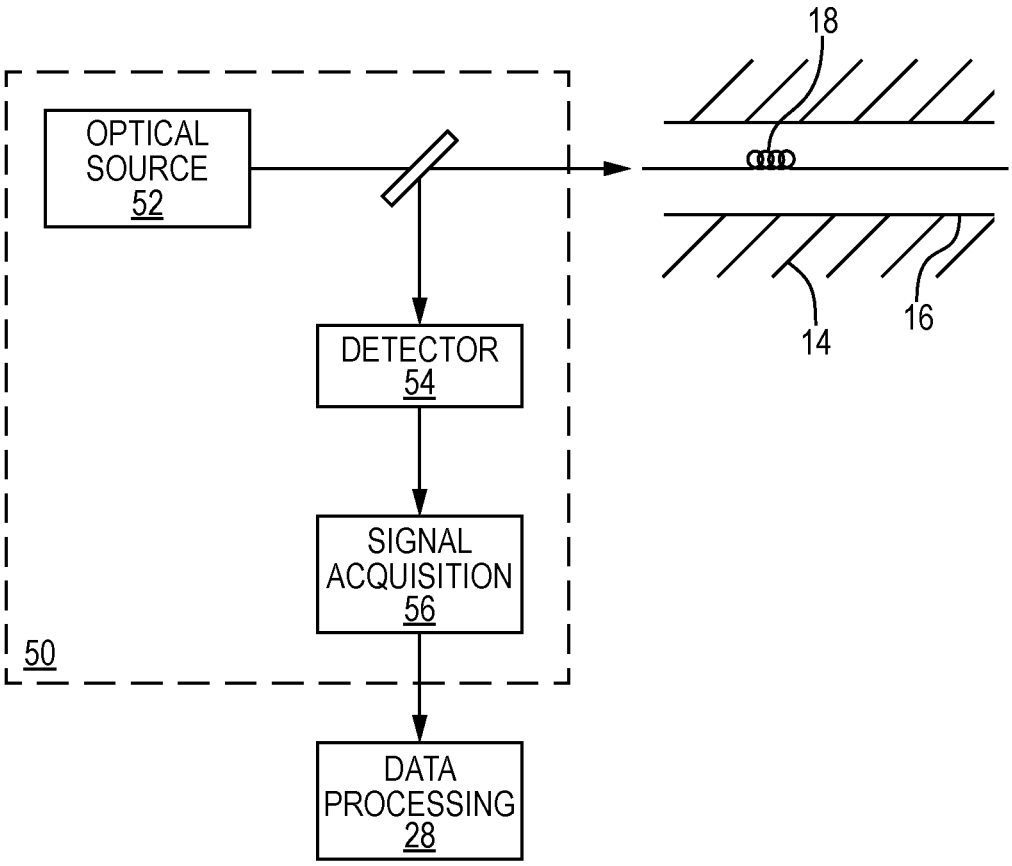
FIG. 1B is a schematic diagram of a portion of a wireline system according to an embodiment of the disclosure.

An example of a system of distributed sensing is described below in relationship with FIG. 1B. A distributed sensing system employs an interrogation and acquisition system 50 having an optical source 52 (e.g., a laser) to generate pulses of optical energy to launch into the optical fiber of the cable 18. As the launched pulses travel along the length of the optical fiber, small imperfections in the fiber reflect a portion of the pulses, generating backscatter. When the fiber is subjected to strain (such as from vibration or acoustic signals propagating through the formation) or temperature changes, the distances between the imperfections change. Consequently, the backscattered light also changes. By monitoring the changes in the backscatter light generated by the fiber in response to interrogating pulses launched by the optical source into the fiber with a detector 54, it is possible to acquire signal therefrom using an acquisition device 56 and determine a parameter of the fiber, such as the dynamic strain, or vibration, or the temperature experienced by the fiber. The measured parameter then can be used to derive information about various parameters of interest, such as characteristics of the surrounding earth formation, as already explained above, for instance using the data processing system 28 already described in relationship with FIG. 1A. The distributed sensing system can be part of or coupled with a processor-based control system (e.g., system 60) used to process the collected data and derive this information.

In DAS systems, a narrowband laser is generally used as an optical source 52 to generate interrogating pulses of light to launch into the sensing optical fiber. The use of a narrowband laser results in interference between backscatter returned from different parts of the fiber that are occupied by a probe pulse at any one time. This is a form of multi-path interference and gives rise to a speckle-like signal in one dimension (along the axis of the fiber), sometimes referred to as coherent Rayleigh noise or coherent backscatter. The term "phase-OTDR (optical time domain reflectometry)" also is used in this context. The interference modulates both the intensity and the phase of the backscattered light and minute (<<wavelength) changes in the length of a section of fiber are sufficient to radically alter the value of the amplitude and phase. Consequently, the technique can be useful for detecting small changes in strain. Such system is disclosed in particular in U.S. Pat. No. 9,170,149.

Figure 2A:
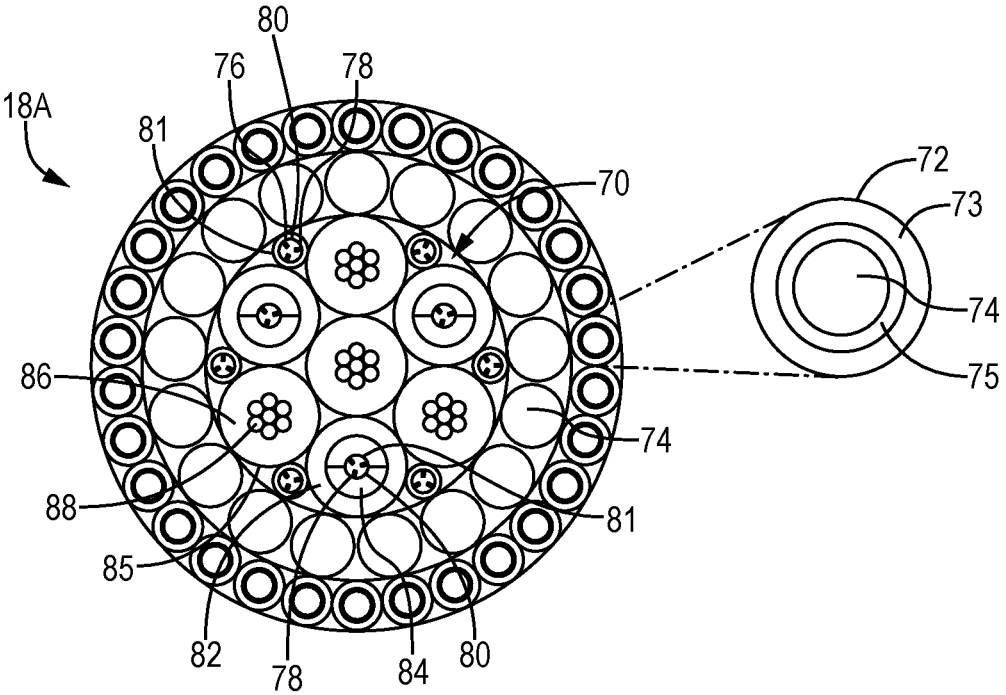
FIGS. 2A and 2B are cross sections of different embodiments of a cable that can be magnetized, in accordance with an aspect of the present disclosure.

FIG. 2A depicts an embodiment of a cross-section of a cable 18A. The present embodiment of the cable 18A allows the cable 18A to magnetically attach to the casing 40 of the wellbore 16. In doing so, the cable 18A holds the toolstring 12 in substantially the same place. In FIG. 2A, the cable 18A is designed to function as an electromagnet. The cable 18A includes three different sections, a cable core 70, strength members 74, and magnetic strength members 72. The cable core 70 may include fiber optic cables 81 and conductors 85. The fiber optic cables 81 may include different configurations. For example, the fiber optic cable 81 may include an optical core 78 and an insulating coating 80 followed by a second insulating coating 76. Alternatively, the second insulating coating 76 may be replaced by spacers 84 followed by an insulating layer 82. While the present embodiment includes three optical cores 78 per fiber optic cable 81, it should be appreciated that each fiber optic cable 81 may include any suitable number of optical cores, including 1, 2, 3, 4, 5, or 6, or more. The conductors 85 include conducting elements 88 surrounded by an insulating material 86. Further, the cable core 70 may be any configuration used for an electro-optical cable (e.g., Coaxial, Triad, Quad, or Hepta). The magnetic strength members 72 include the strength member 74 followed by a layer of insulated strength members/conductors 75 (e.g., using bimetallic materials) followed by a layer of durable polymeric electrical insulation 73. In the present embodiment, the magnetic strength members 72 are disposed further from the cable core 70 than the strength members 74; however, it should be appreciated that the magnetic strength members 72 may be disposed closer to the cable core 70 than strength members 74. Additionally or alternatively, the magnetic strength members 72 may be disposed in a mixed configuration with the strength member 74, with some magnetic strength members 72 further from the cable core 70 and some closer to the cable core 70 than the strength members 74. Each of the strength members 74 or a portion of the strength members 74 in the armor matrix can be magnetic strength members 72. The quantity, material, size and lay angles of the magnetic strength members 72 combined with the electrical current applied can be altered to create an electromagnet of sufficient strength to hold the cable 18A in place against the casing 40 of the wellbore 16. Surface and downhole electronics may be configured to turn the magnetic strength members 72 on and off. In the "Off" mode, return current is carried by the strength members 74. In the "On" position, current is returned on the magnetic strength members 72 and cause the magnetic strength member 72 to function as an electromagnet. In multiple-conductor cable cores, one or more conductors can be replaced with hybrid conductors. A hybrid conductor is a cable that contains multiple strands wrapped around one another, and the strands may be composed of multiple types of metals (e.g., steel, bimetallic, etc.).

Figure 2B:
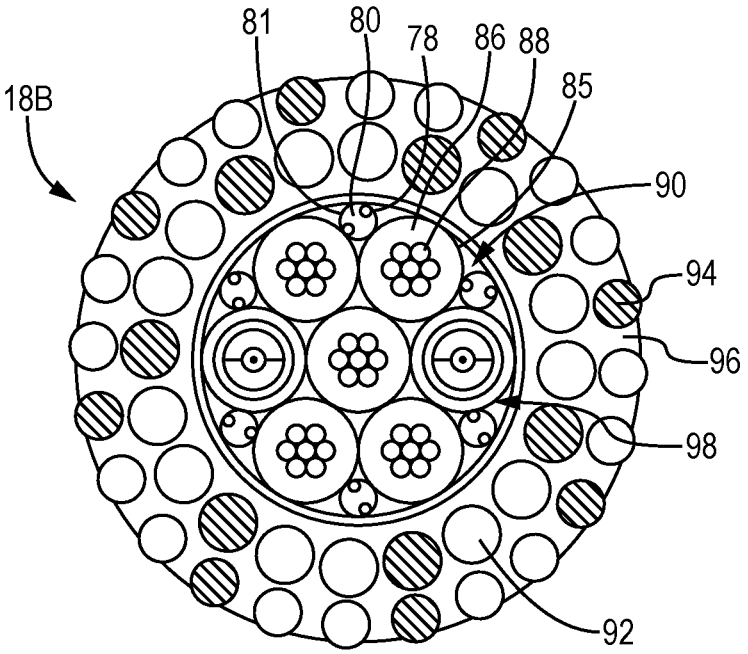

FIG. 2B depicts a cross-section of an alternative embodiment of the cable 18. A cable 18B is designed to function as an electromagnet, and the cable 18B includes a cable core 90, strength members 92, and magnetic strength members 94. The strength members 92 may be magnetic strength members 94. The cable core 90 includes fiber optic cables 81, conductors 85, and wires 98. The fiber optic cables 81 include the optical cores 78 followed by the insulating coating 80. The conductors 85 include conducting elements 88 surrounded by an insulating material 86. The cable core 90 may be any configuration used for an electro-optical cable (e.g., Coaxial, Triad, Quad, or Hepta). All the strength members 92 or a portion of the strength members 92 may be replaced with magnetic strength members 94 (e.g. bi-metallic) in order to balance the cable 18B safe working load and magnetic anchoring force. The material, quantity, size and lay angles of magnetic strength members 94 and the electrical current applied may be configured to create an electromagnet of sufficient strength to hold the cable 18B in place against the casing 40 of the wellbore 16. Strength member 92 and magnetic strength members 94 may be held in place by a filler material 96. The filler material may include insulating elements. Surface and downhole electronics are configured to turn the electromagnet on and off. In the "Off" mode, return current is carried by conductors in the cable core 90. In the "On" position, current is returned on the magnetic strength members 94 causing the magnetic strength members 94 to function as an electromagnet. In multiple-conductor cable cores, one or more conductors can be replaced with hybrid conductors.

Figure 3A:
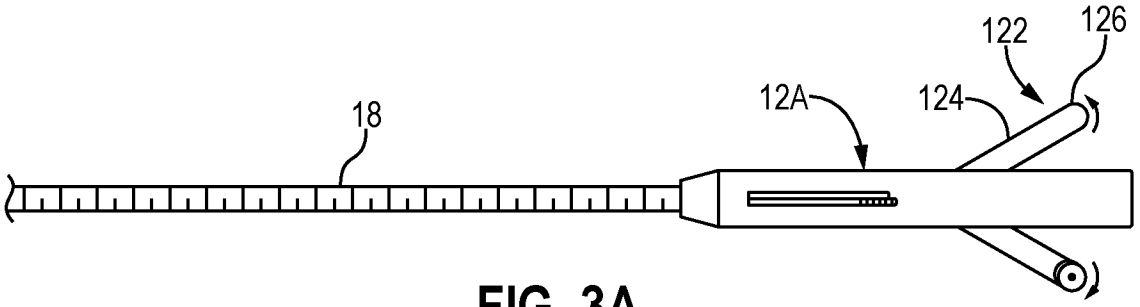
FIG. 3A is a side view of an embodiment of a toolstring with the arms of a tractor device extended, in accordance with an aspect of the present disclosure.
Figure 3B:
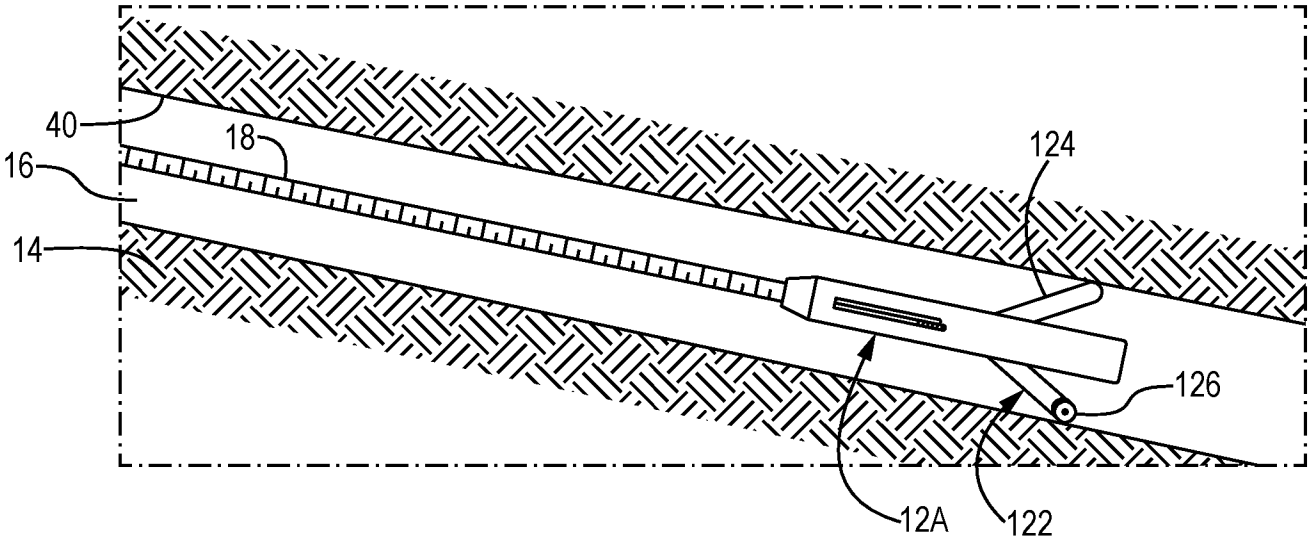
FIG. 3B is a side view of the toolstring of FIG. 3A in a wellbore, in accordance with an aspect of the present disclosure.

FIG. 3A is a side view of an embodiment of a toolstring 12A attached to the cable 18. The cable 18 may be either embodiment depicted in FIGS. 2A and 2B. In the present embodiment, the toolstring 12A includes a tractor device 122. The tractor device 122 includes arms 124, and each arm 124 includes a drive wheel 126. The tractor device 122 may include any suitable number of arms 124, including 1, 2, 3, 4, 5, 6, or more. In operation, the cable 18 and the toolstring 12A are lowered into the wellbore 16 on the cable 18, initially by gravity. The tractor device 122 attached to the toolstring 12A is used to continue propelling the toolstring 12A into the hole of the wellbore 16 in substantially horizontal (i.e., greater than sixty degrees with respect to the surface of the ground) portions of the wellbore 16. As depicted in FIG. 3B, the tractor device 122 uses drive wheels 126 on arms 124 that extend from the toolstring 12A to propel the toolstring 12A down the casing 40 of the wellbore 16.

Figure 3C:
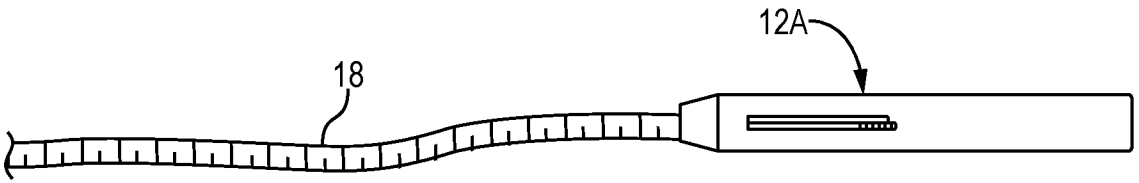
FIG. 3C is a side view of the toolstring of FIG. 3A with the cable magnetized and the arms of the tractor device retracted, in accordance with an aspect of the present disclosure.
Figure 3D:
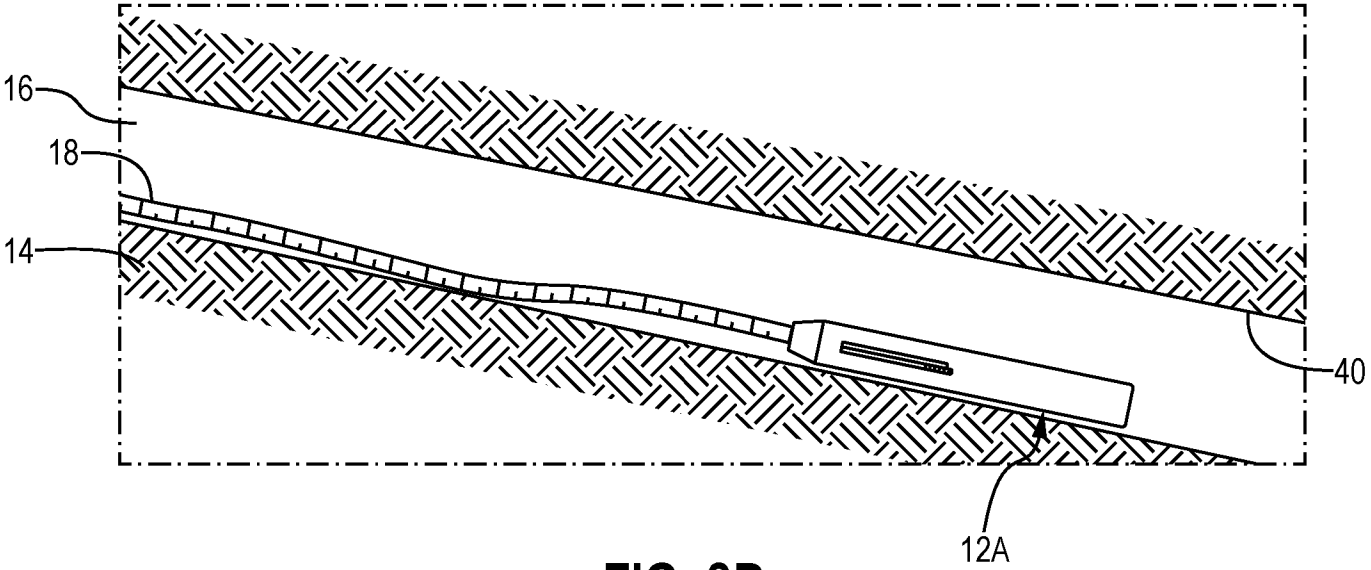
FIG. 3D is a side view of the toolstring of FIG. 3C in a wellbore and with the cable magnetized and held to the casing of the wellbore, in accordance with an aspect of the present disclosure.

FIGS. 3C and 3D are side views of the toolstring 12A with the arms 124 of the tractor device 122 retracted and the cable 18 in the "On" position. Once the cable 18 and toolstring 12A are in the desired location, the arms 124 on the tractor device 122 are withdrawn and the cable 18 is turned to the "On" position. The return current is switched to the magnetic strength members 72 or 94. Applying electrical current to the magnetic strength members 72 or 94 allows the cable 18 to function as an electromagnet. The strength of the electromagnet may be adjusted by changing amount of current applied or by adjusting the material, quantity, diameters and lay angles of the insulated strength member/conductors. Further, the magnetic strength members 72 and 94 may be included on a portion of the cable 18. For example, the magnetic strength members 72 and 94 may be included on a portion of the cable 18 near the toolstring 12.

Figure 4:
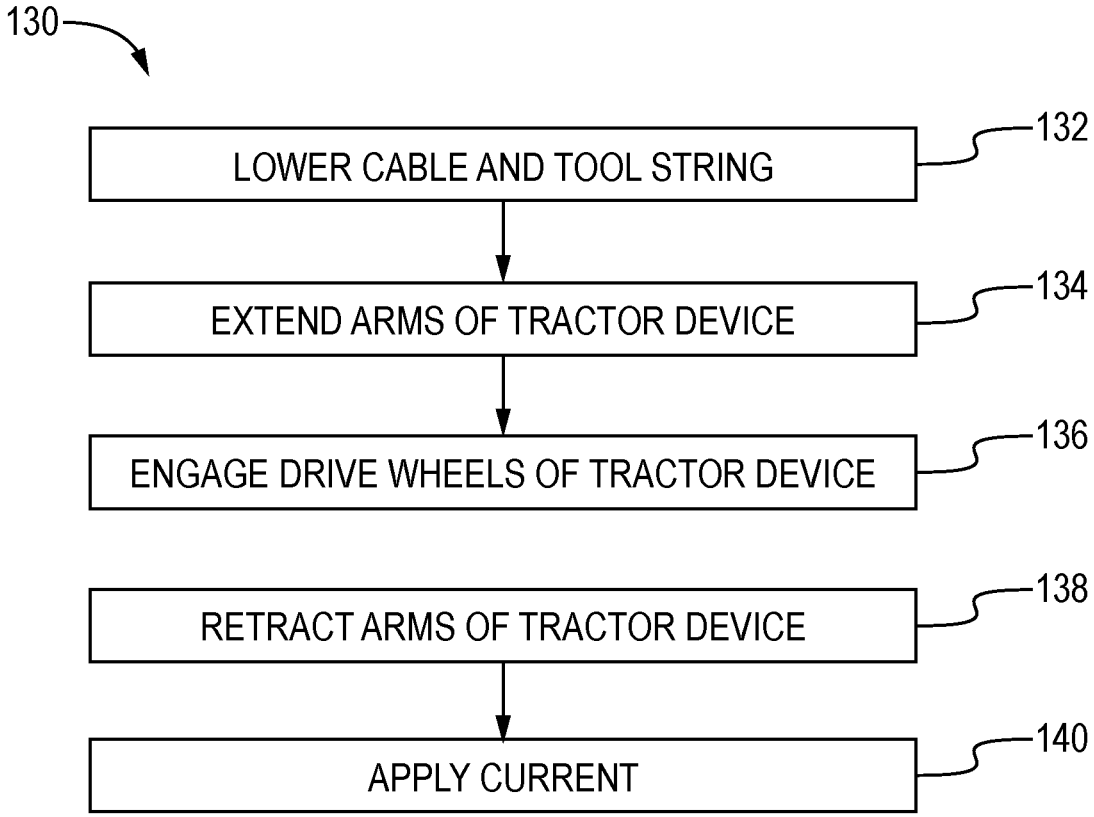
FIG. 4 is a flow chart for a method for lowering the toolstring and holding the cable against the casing of the wellbore, in accordance with an aspect of the present disclosure.

FIG. 4 illustrates a flowchart of a method 130 for improving the signal to noise ratio. The method 130 includes lowering (block 132) the cable 18 and the toolstring 12 into the wellbore 16, initially by gravity. The method 130 includes extending (block 134) the arms 124 of the tractor device 122. The method 130 includes engaging (block 136) the drive wheels 126 of the tractor device 122. The drive wheels 126 may be engaged against a surface of the wellbore 16, thereby propelling the toolstring 12 deeper into the wellbore 16. The method 130 includes retracting (block 138) the arms 124 of the tractor device 122. The method 130 includes applying (block 140) current to the magnetic strength members 72 or 94 of the cable 18. As previously discussed, applying current to the magnetic strength members 72 or 94 allows the cable 18 to function as an electromagnet. The cable 18 may then be pulled taught to keep the cable 18 steady while the fiber optic cables transmit data. The cable 18 being kept steady reduces the signal to noise ratio of the data transmitted through the fiber optic cables.

Figure 5A:
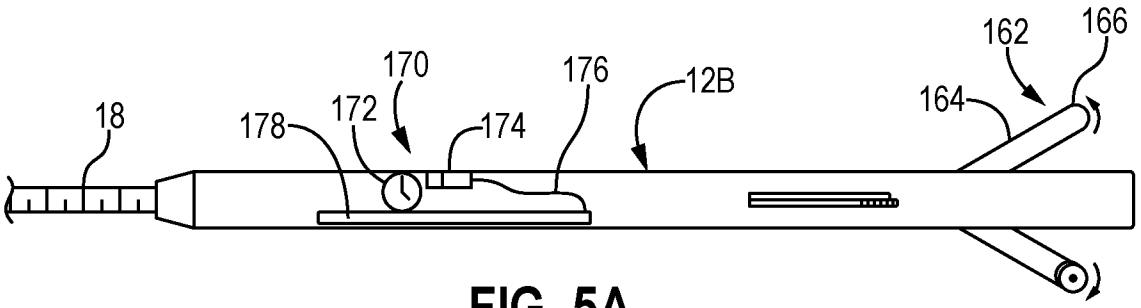
FIG. 5A is a side view of an embodiment of a toolstring including a timer-activated magnetic device with the arms of the tractor device extended, in accordance with an aspect of the present disclosure.
Figure 5B:
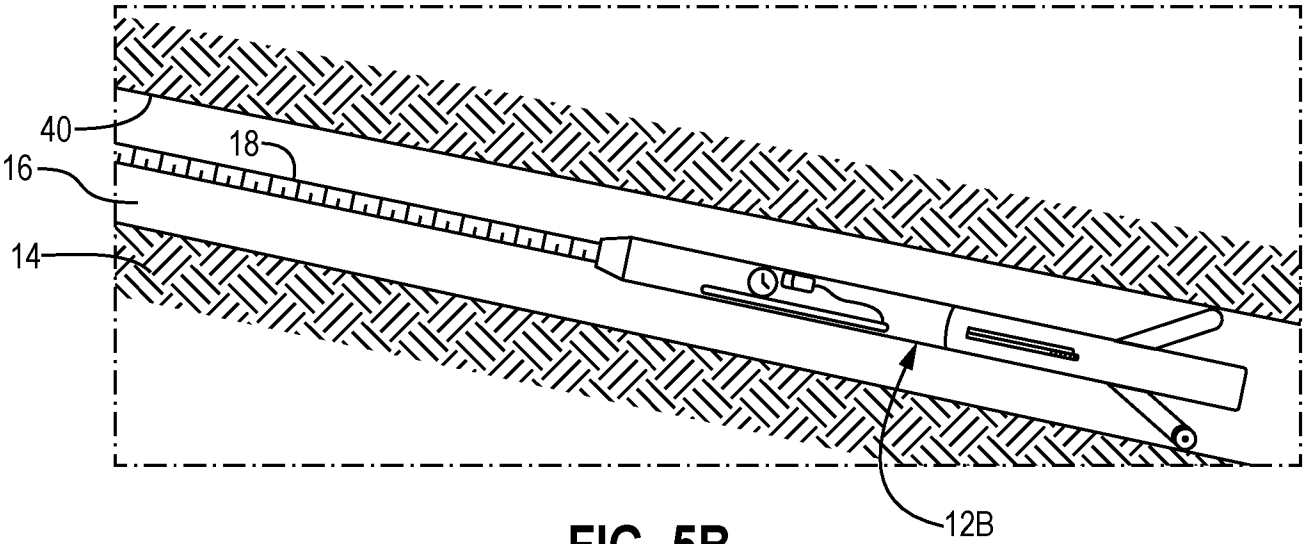
FIG. 5B is a side view of the toolstring of FIG. 5A in a wellbore, in accordance with an aspect of the present disclosure.

FIG. 5A is a side view of an embodiment of a toolstring 12B including a timer-activated magnetic device 170 with the arms 164 of the tractor device 162 extended. The timer-activated magnetic device 170 is powered by a battery 174 and the timer-activated device 170 is located in the toolstring 12B. Before running the toolstring 12B and cable 18 into the wellbore 16, the timer 172 is set to activate after allowing sufficient time for the cable 18 to run into the wellbore 16 to the desired location. The cable 18 and the toolstring 12 are lowered into the wellbore 16 on the cable 18, initially by gravity. A tractor device 162 attached to the toolstring 12 is used to continue running the toolstring 12 into the wellbore 16 in substantially horizontal portions of the wellbore 16. The current returned through the armor can be used to store energy in the battery 174 and extend the magnetic anchoring period. As depicted in FIG. 5B, the tractor device 162 uses drive wheels 166 on arms 164 that extend from the toolstring 12B to propel the toolstring 12B down the casing 40 of the wellbore 16.

Figure 5C:
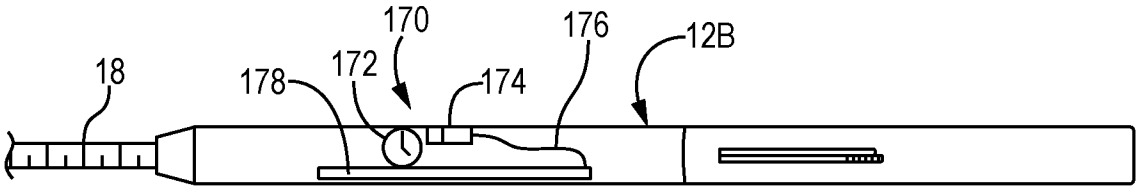
FIG. 5C is a side view of the toolstring of FIG. 5A with the arms of the tractor device retracted, in accordance with an aspect of the present disclosure.
Figure 5D:
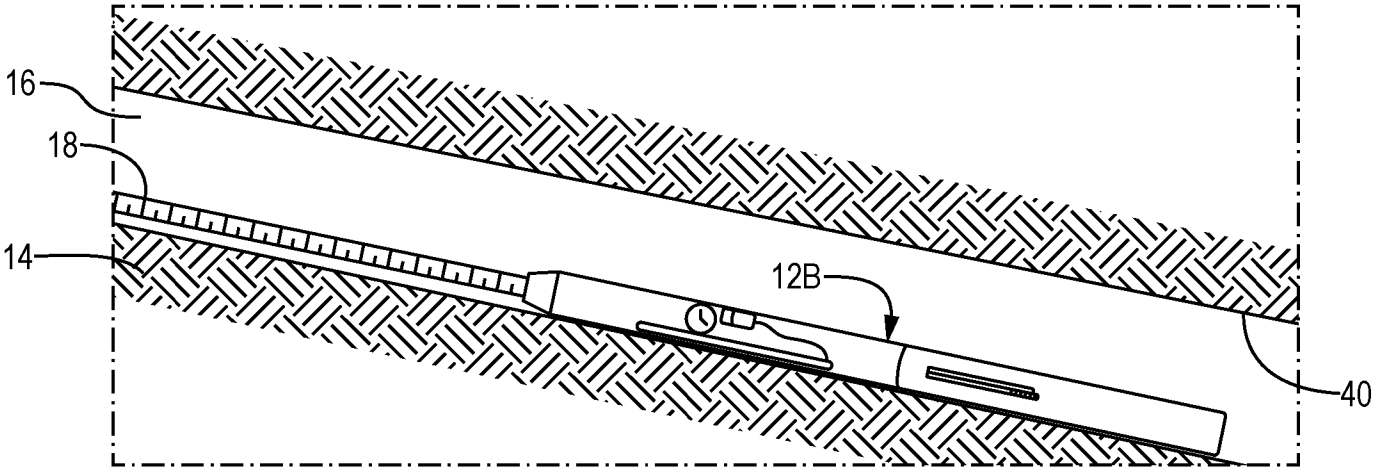
FIG. 5D is a side view of the toolstring of FIG. 5C in a wellbore and with the selectively magnetic device holding the toolstring to the casing of the wellbore, in accordance with an aspect of the present disclosure.
Figure 5E:
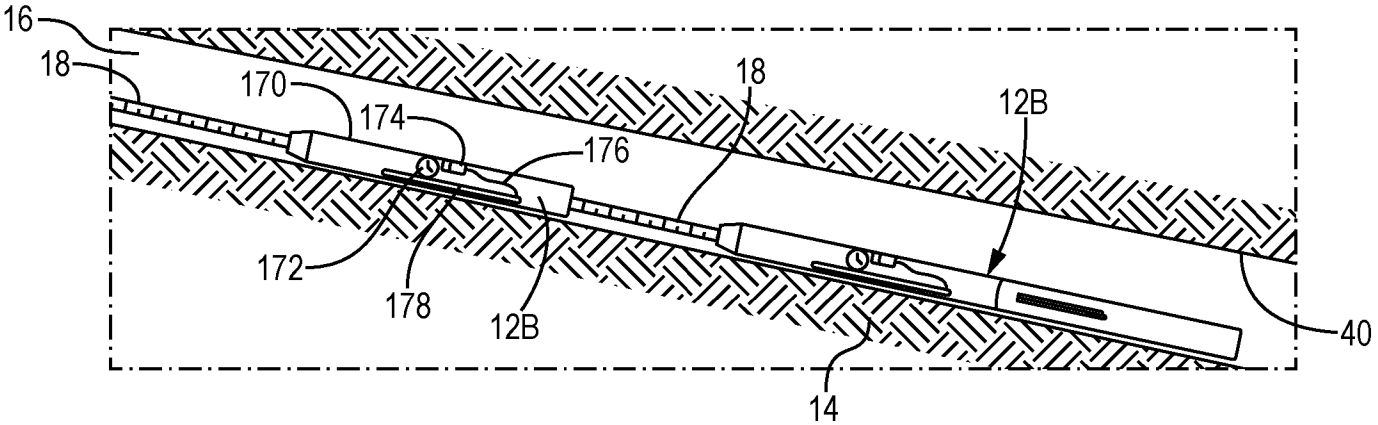
FIG. 5E is a side view of the toolstring of FIG. 5D, with an additional toolstring mounted on the cable, in accordance with an aspect of the present disclosure.

FIGS. 5C and 5D are side views of the toolstring 12B with the arms 164 of the tractor device 162 retracted. Once the timer 172 reaches the end of its time, the timer 172 activates a switch 176 of the timer-activated magnetic device 170 (which will allow time for the toolstring 12B to arrive at the desired downhole location). Activating the switch 176 supplies power from the battery 174 to the electromagnet 178. Activating the switch 176 also causes the drive wheels 166 of the tractor device 162 to retract into the toolstring 12B. The electromagnet 178 holds the toolstring 12B in place against the casing 40 of the wellbore 16. The cable 18 can then be tightened to hold it taut against the casing 40 of the wellbore 16, allowing the fiber optics of the cable 18 to transmit a strong and consistent signal from downhole formations. FIG. 5E is a side view of the toolstring 12B of FIG. 5D, with a second timer-activated magnetic device 170 mounted on the cable 18. Multiple timer-activated magnetic devices 170 may be located at any suitable location along the length of the cable 18.

Figure 6:
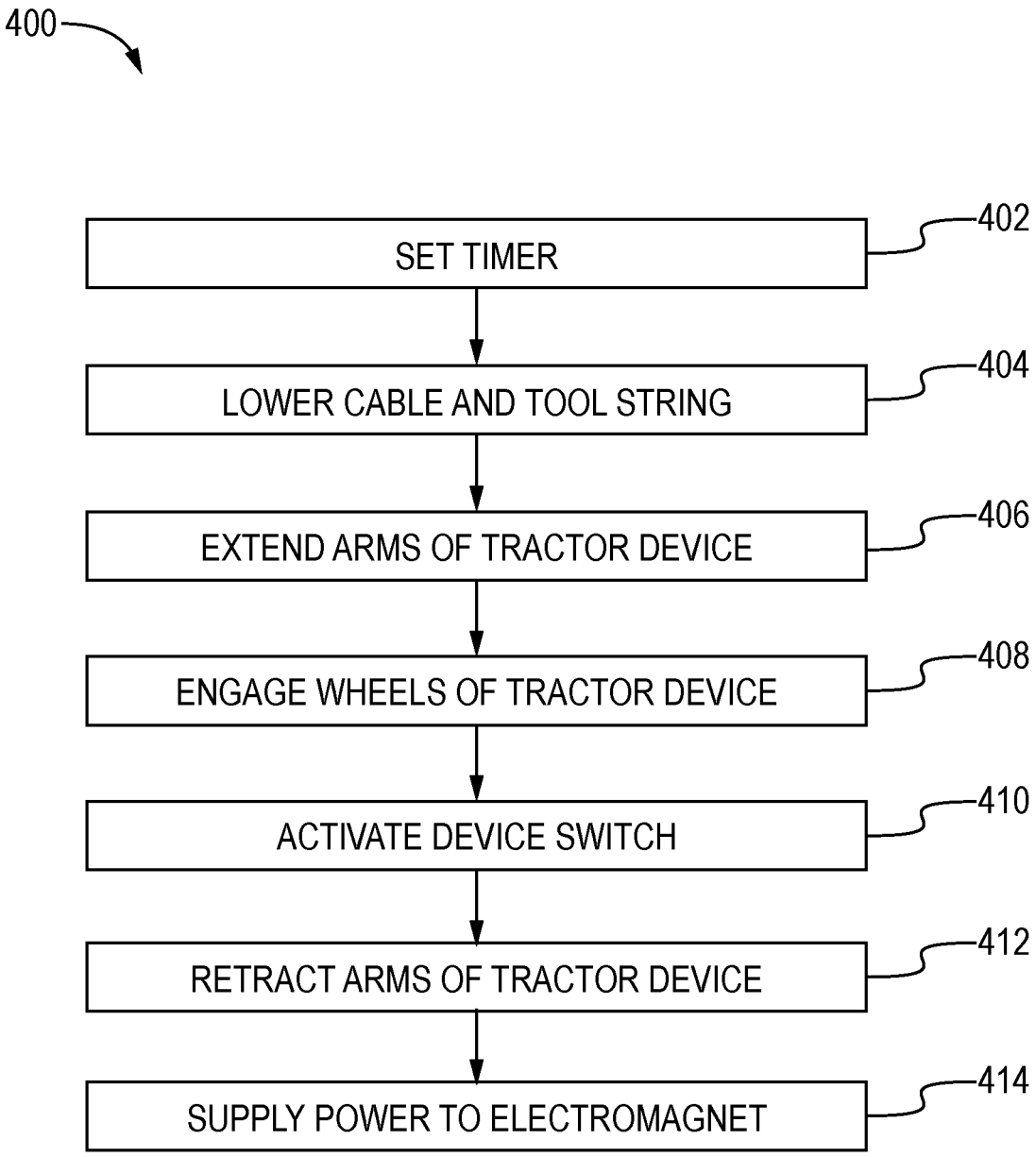
FIG. 6 is a flow chart for a method for lowering the toolstring and holding the cable against the casing of the wellbore using a timer device, in accordance with an aspect of the present disclosure.

FIG. 6 illustrates a flowchart of a method 400 for improving the signal to noise ratio. The method 400 includes setting (block 402) the timer 172 of the timer-activated magnetic device 170. The method 400 includes lowering (block 404) the cable 18 and the toolstring 12 into the wellbore 16, initially by gravity. The method 400 includes extending (block 406) the arms 164 of the tractor device 162. The method 400 includes engaging (block 408) the drive wheels 166 of the tractor device 162. The drive wheels 166 may engage a surface of the wellbore 16, thereby driving the toolstring 12 deeper into the wellbore 16. The method 400 includes activating (block 410) the switch 176 of the timer-activated magnetic device 170. The method 400 includes retracting (block 412) the arms 164 of the tractor device 162. The method 400 includes supplying (block 414) power to the electromagnet 178. In the present embodiment, the power is supplied by a battery 174, but the power may be supplied from other structure, including the cable 18. Supplying power to the electromagnet 178 causes the electromagnet 178 to attach to the casing 40 of the wellbore 16. The cable 18 may then be pulled taught to keep the cable 18 steady while the fiber optic cables transmit data. The cable 18 being kept steady reduces the signal to noise ratio of the data transmitted through the fiber optic cables.

Figure 7A:
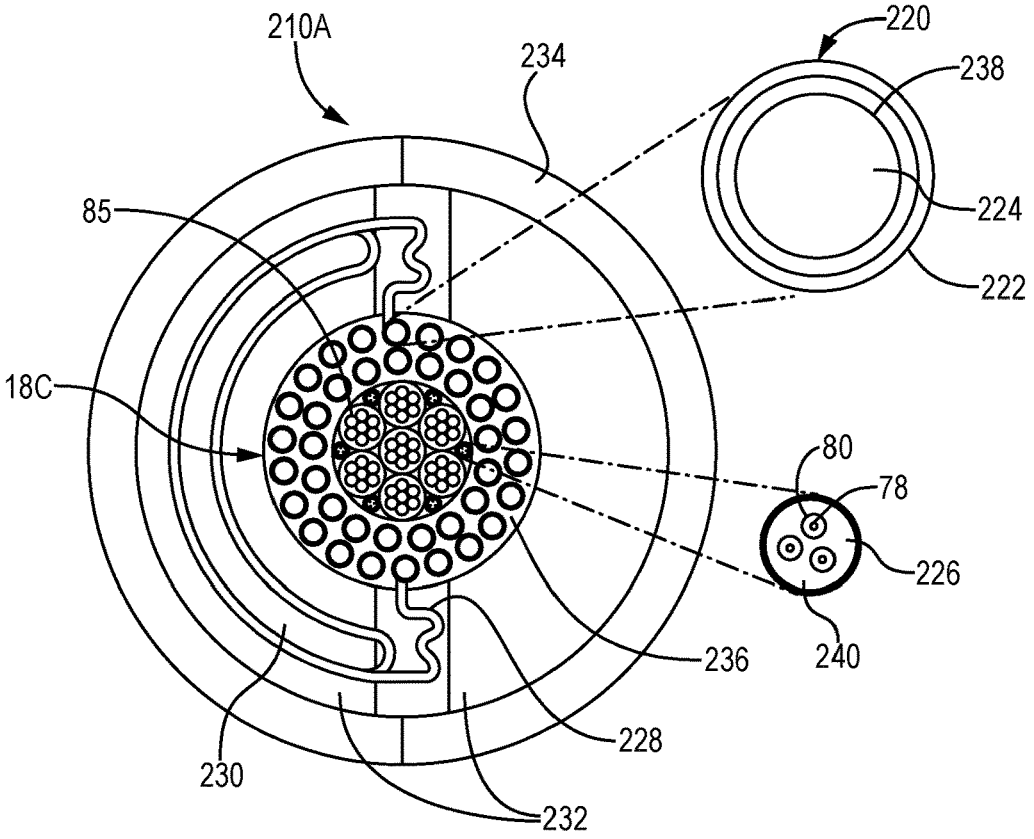
FIGS. 7A-7B are cross sections of different embodiments of the cable with a magnetic device coupled to the cable, in accordance with an aspect of the present disclosure.

FIG. 7A is a cross section of an embodiment of a cable 18C with a magnetic device 210A coupled to the cable 18C. The magnetic device 210A is installed as needed along the cable 18C and is powered by insulated magnetic strength members 220. Insulated magnetic strength members 220 include insulation 222 (e.g., durable polymetric electrical insulation). A number of strength members 224 are replaced by insulated magnetic strength members 220. Insulated magnetic strength members 220 can be made out of bimetallic material or any suitable magnetic material. A separate insulated magnetic strength member 220 may be used for each magnetic device 210A so that each magnetic device 210A may be operated independently. The magnetic device 210A is installed over the cable 18C in two halves that come together and are held together by a magnetic device casing 234 to form a cylinder. The cable 18C includes a cable core 236, strength members 224, and insulated magnetic strength members 220. The cable core 236 may include fiber optic cables 81 and conductors 85. The fiber optic cables 81 may include an optical core 78 and an insulating coating 80 followed by a second insulating coating 226 and an outer insulating layer 240. One side of the cylinder contains an electromagnet 230. The electromagnet 230 is a semi-circular-profile iron bar wrapped tightly in insulated copper wire. Non-conductive spacers 232 hold the electromagnet 230 in place within the gap between the magnetic device casing 234 and the cable 18C. One end of an insulated conductive wire 228 is attached to the insulated magnetic strength member 220, and the other end is attached to the electromagnet 230. Sufficient slack is allowed in the insulated conductive wires 228 to enable the connections to insulated magnetic strength members 220 that tend to rotate under longitudinal stress. When current is applied to the insulated magnetic strength members 220, the electromagnet 230 is activated and attaches the magnetic device 210A to the casing 40 of the wellbore 16.

Figure 7B:
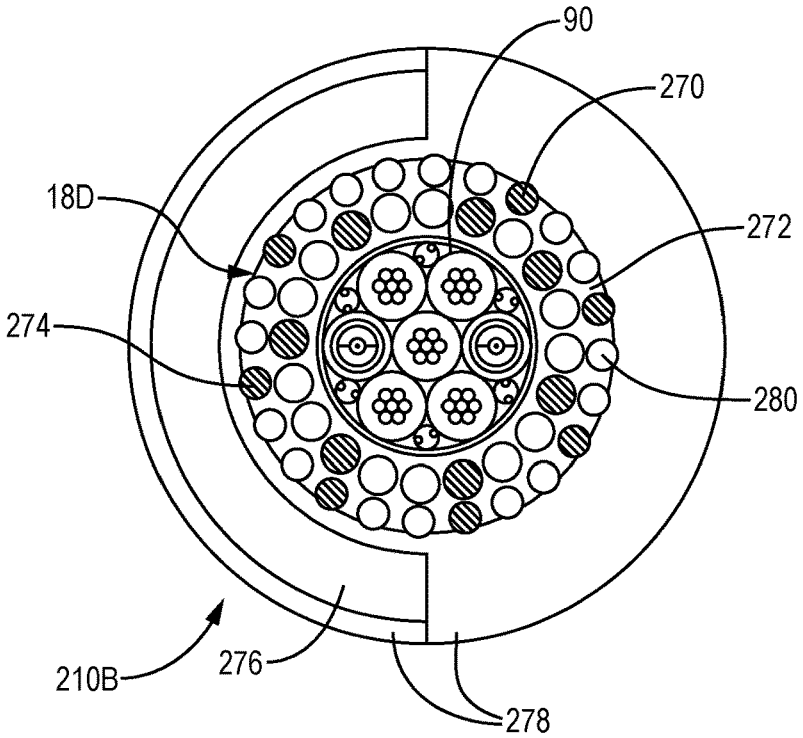

FIG. 7B is a cross section of an embodiment of a cable 18D with a magnetic device 210B coupled to the cable 18D. The cable 18D includes the cable core 90, insulated magnetic strength members 270, strength members 280, and a filler material 272 (e.g., an insulating material). The magnetic device 210B is installed along the cable 18D and powered by insulated magnetic strength members 270. A number of strength members 280 (e.g., standard armor wire) are replaced by the insulated magnetic strength members 270. The insulated magnetic strength members 270 may be made out of bimetallic material or any suitable magnetic material to increase the force of attraction between magnetic device 210B and casing 40 of the wellbore 16. The magnetic device 210B is installed over the cable 18D in two halves that come together to form a cylinder. One side contains an electromagnet 276. Spacers 278 hold the electromagnet 276 in place on the cable 18D. When current is applied to the insulated magnetic strength members 270, the electromagnet 276 is activated and attaches the magnetic device 210B to the casing 40 of the wellbore 16. Alternatively, the electromagnet 276 could be replaced with a permanent magnet. This coupling device is particularly useful in cased hole applications.

Figure 8A:
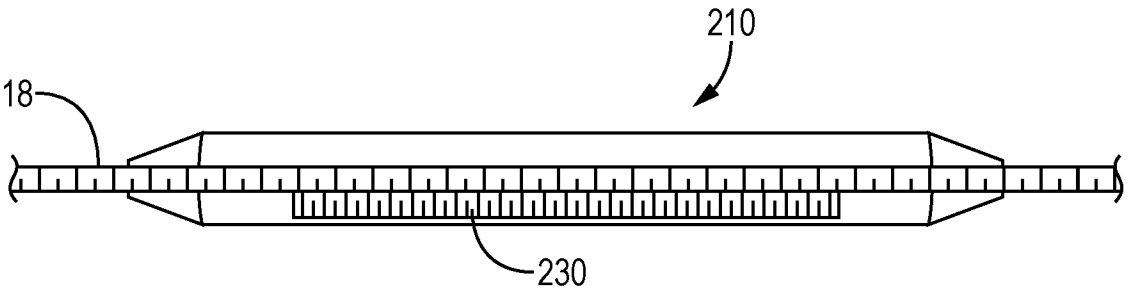
FIG. 8A is a side view of an embodiment of the magnetic device, in accordance with an aspect of the present disclosure.
Figure 8B:
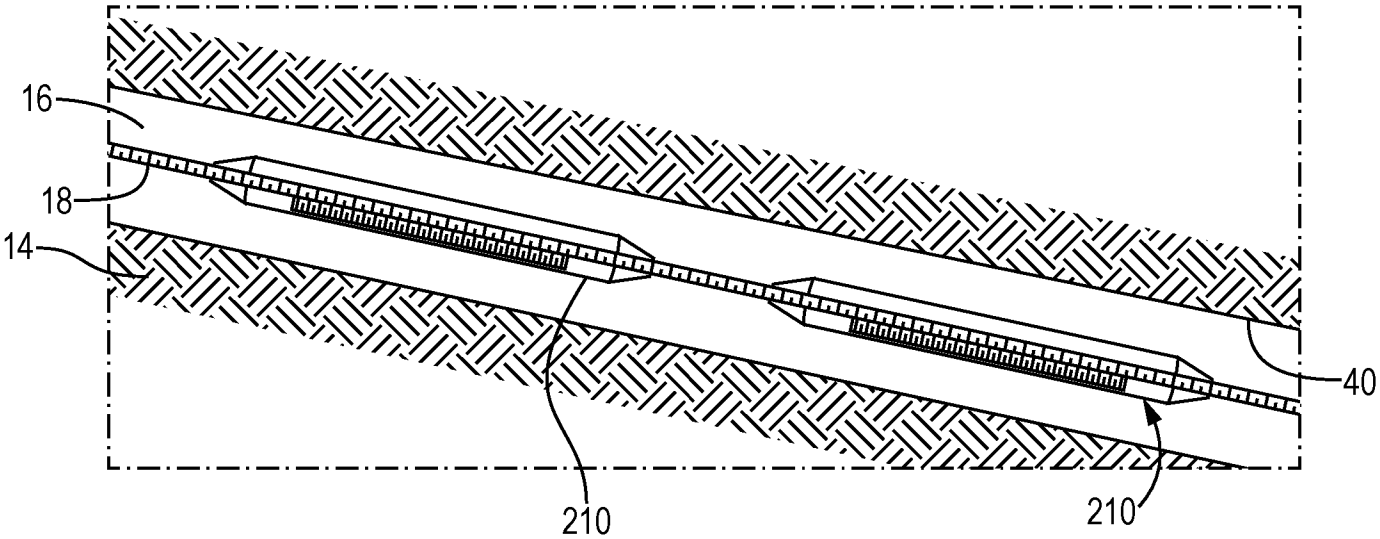
FIG. 8B is a side view of multiple magnetic devices of FIG. 8A in a wellbore, in accordance with an aspect of the present disclosure.
Figure 8C:
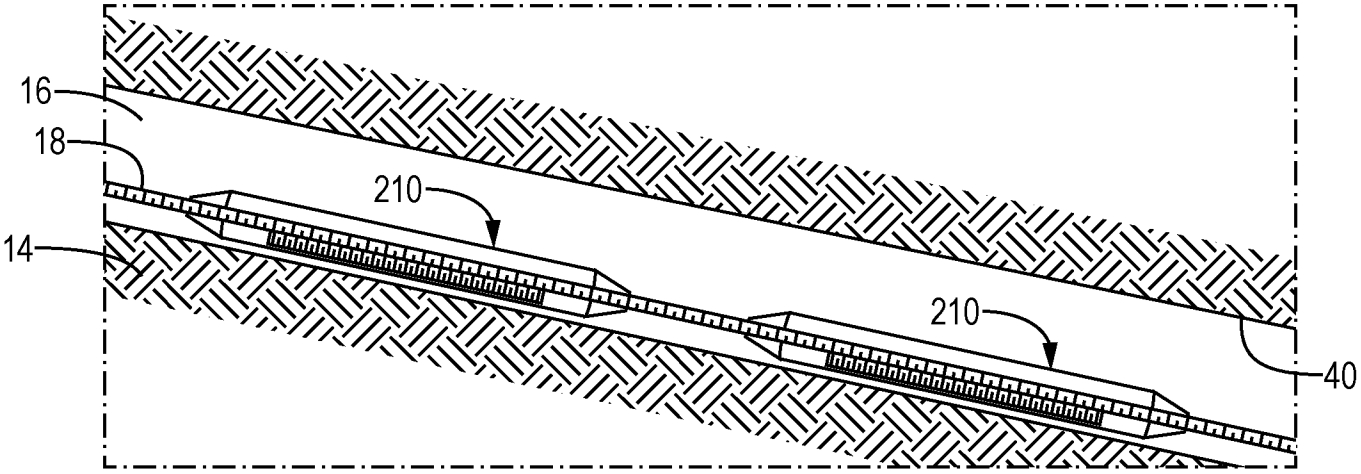
FIG. 8C is a side view of the magnetic devices of FIG. 8B attached to the casing of the wellbore, in accordance with an aspect of the present disclosure.

FIGS. 8A and 8B are a side view of the magnetic device 210. The magnetic device 210 may include either the magnetic device 210A or 210B. As shown in FIG. 8B, the cable 18 may include multiple magnetic devices 210. The magnetic devices 210 may be spread along the cable 18 at any distance as is desired. FIG. 8C is a side view of the magnetic devices 210 attached to the casing 40 of the wellbore 16. Once the magnetic device 210 has advanced to the desired location in the well, current is applied as described above to activate the electromagnet 230 or 276. The magnetic device 210 attaches magnetically to the casing 40 of the wellbore 16. The cable 18 is pulled taut and any other magnetic devices 210 are also activated to hold the cable 18 against the casing 40 of the wellbore 16. The cable 18 can then be tightened to hold it taut against the casing 40 of the wellbore 16, thereby allowing the fiber optics of the cable to receive a strong and consistent signal from downhole formations. Pressing the cable 18 against the casing 40 of the wellbore 16 may also press the toolstring 12 against the casing 40.

Figure 9A:
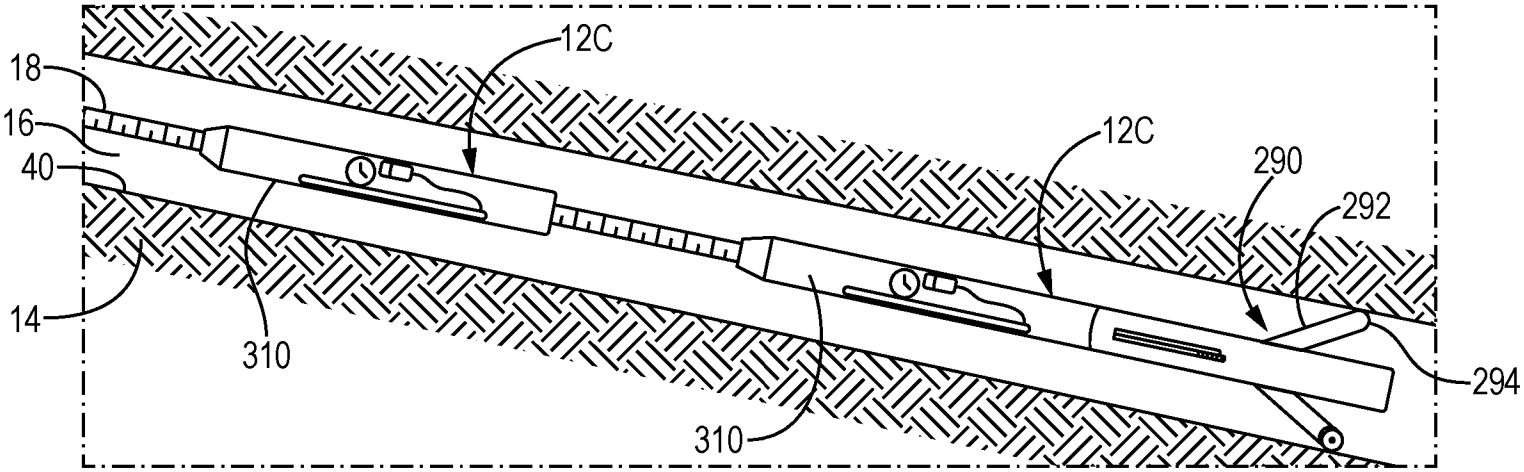
FIG. 9A is a side view of an embodiment of the toolstring including an anchoring device and a tractor device and the arms of the tractor device are extended, in accordance with an aspect of the present disclosure.

FIG. 9A is a side view of an embodiment of a toolstring 12C including an anchoring device 310 and a tractor device 290 and the arms 292 of the tractor device 290 are extended. The present embodiment includes two toolstrings 12C, and only one of the toolstrings includes the tractor device 290. The cable 18 and the toolstring 12C are lowered into the wellbore 16, initially by gravity. The tractor device 290 of the toolstring 12C is used to continue running the toolstring 12C into the wellbore 16 in substantially horizontal portions of the well. Once the toolstring 12C is at the desired location, the drive wheels 294 of the tractor device 290 retract.

Figure 9B:
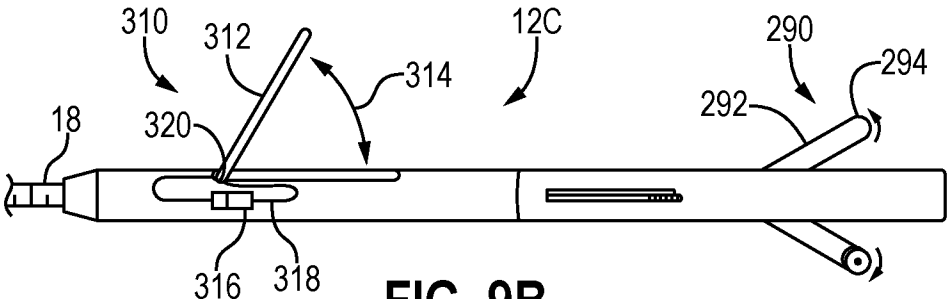
FIG. 9B is a side view of the toolstring of FIG. 9A and the side-arm of the anchoring device extended, in accordance with an aspect of the present disclosure.
Figure 9C:
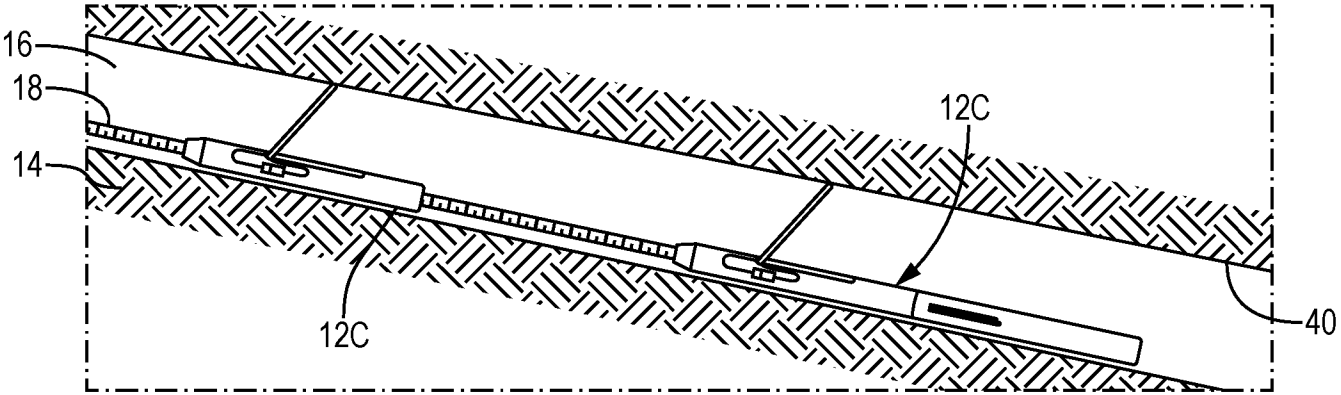
FIG. 9C is a side view of multiple toolstring of FIG. 9B with the arms of the tractor devices retracted and the side-arms of the anchoring devices extended and holding the toolstrings against the casing of the wellbore, in accordance with an aspect of the present disclosure.

FIG. 9B is a side view of the toolstring 12C with the anchoring device 310 activated. FIG. 9C is a side view of two toolstrings 12C, both with the anchoring device 310 activated. The anchoring devices 310 in the toolstring 12C are activated by telemetry signals sent through the cable 18 from the surface. The telemetry signals cause a switch 318 to either engage or disengage. The telemetry signals cause the switch 318 to engage once the toolstring 12C has reached the desired location in the wellbore 16. However, while the switch 318 is engaged or disengaged by telemetry signals in the present embodiment, it should be noted that the switch 318 may be engaged or disengaged by a program designed to engage the switch 318 after a sufficient amount of time has passed. The anchoring devices 310 have a single side-arm 312 that deploys in direction 314 to anchor the toolstrings 12C and the cable 18 to the casing 40 of the wellbore 16 when the switch 318 is engaged. The side-arm 312 of the anchoring device 310 swings outward about a hinge 320 in the direction 314 to wedge the toolstring 12C in place against the casing 40 of the wellbore. In the present embodiment, the anchoring device 310 is powered by a battery 316; however, it should be appreciated that the anchoring device 310 may also be powered by power supplied through the cable 18.

Figure 10:
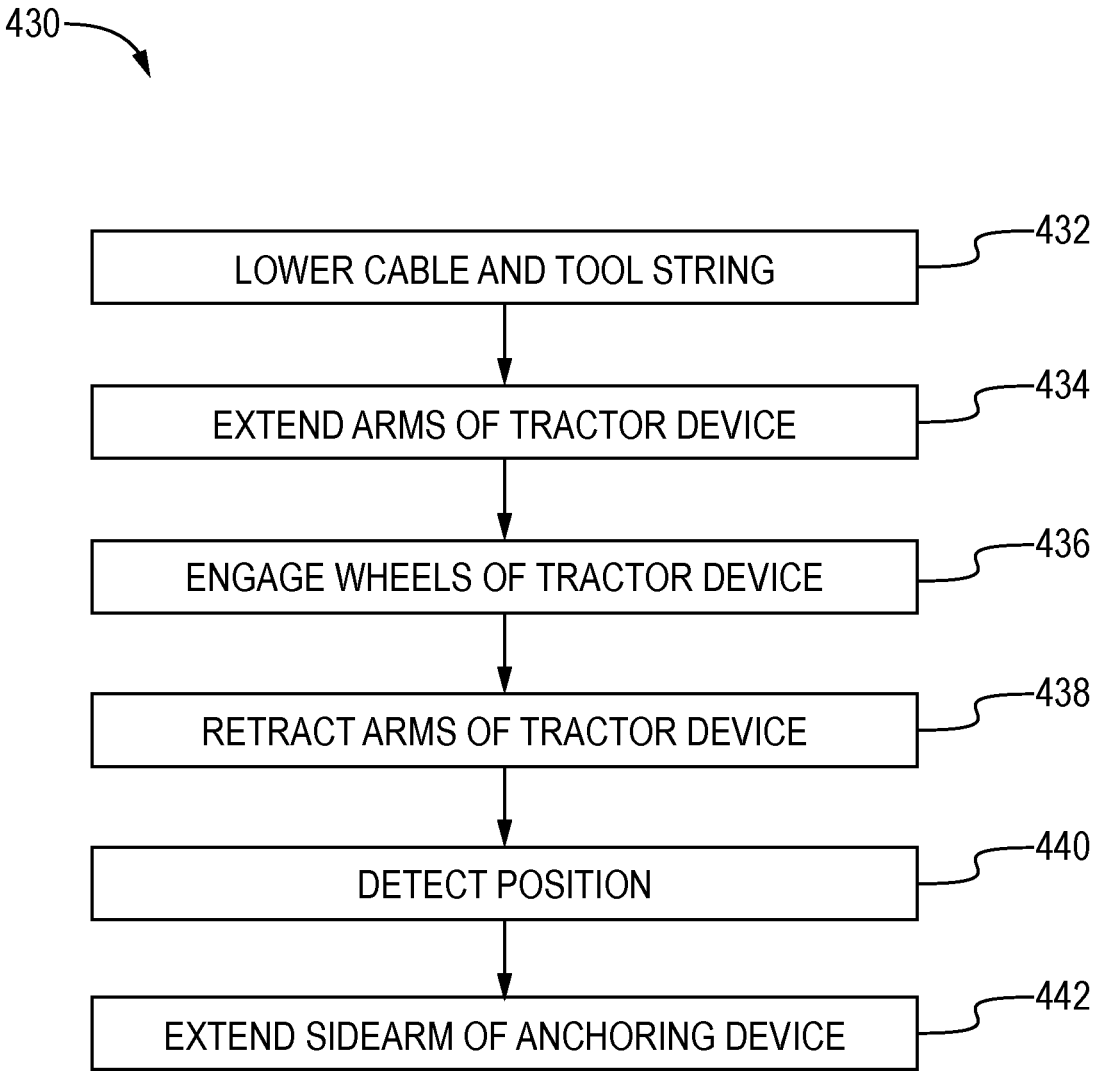
FIG. 10 is a flow chart for a method for lowering the toolstring and holding the cable against the casing of the wellbore using an anchoring device, in accordance with an aspect of the present disclosure.

FIG. 10 illustrates a flowchart of a method 430 for improving the signal to noise ratio. The method 430 includes lowering (block 432) the cable 18 and the toolstring 12 into the wellbore 16, initially by gravity. The method 430 includes extending (block 434) the arms 292 of the tractor device 290. The method 430 includes engaging (block 436) the drive wheels 294 of the tractor device 290. The drive wheels 294 may be engaged against a surface of the wellbore 16, thereby driving the toolstring 12 deeper into the wellbore 16. The method 430 includes retracting (block 438) the arms 292 of the tractor device 290. Then, the method 430 includes detecting (block 440) the position of the toolstring 12 using telemetry signals. The method 430 includes extending (block 442) the side-arm 312 of the anchoring device 310. Extending the side-arm 312 wedges the toolstring 12 against the casing 40 of the wellbore 16.

Figure 11A:
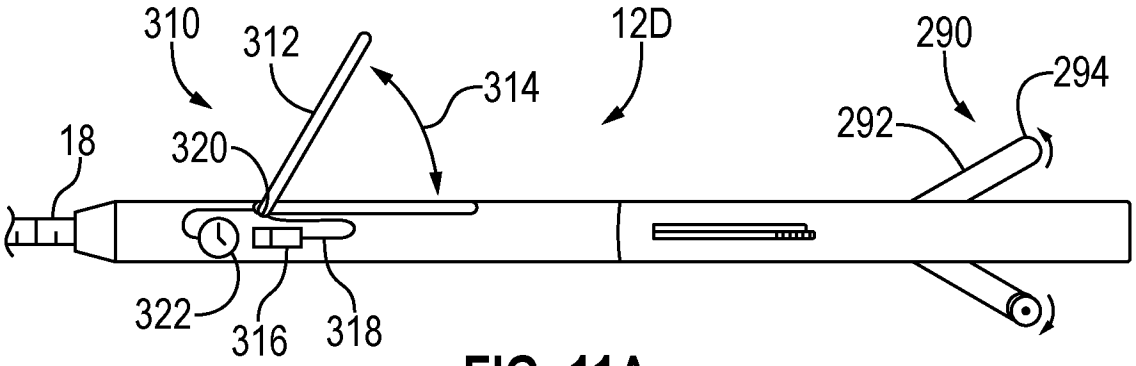
FIG. 11A is a side view of the toolstring of FIG. 9A where the anchoring device is activated by a timer device, in accordance with an aspect of the present disclosure.
Figure 11B:
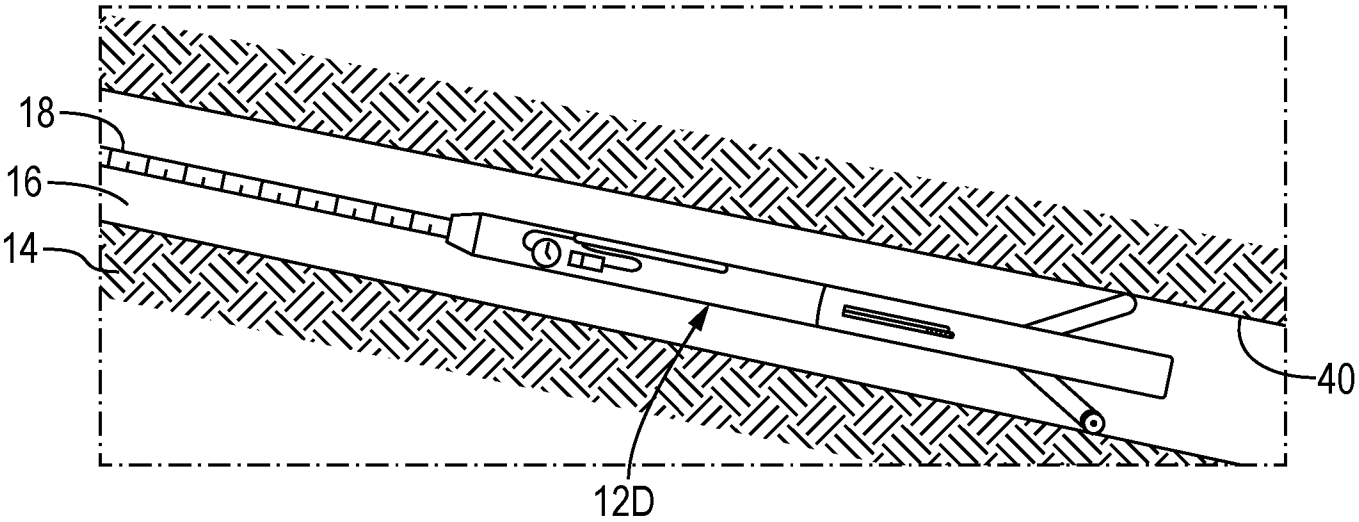
FIG. 11B is a side view of the toolstring of FIG. 11B in a wellbore and with the arms of the tractor device extended, in accordance with an aspect of the present disclosure.

FIG. 11A is a side view of the toolstring 12C of FIG. 9A where the anchoring device 310 is activated by a timer device 322. FIG. 11B is a side view of the toolstring 12D of FIG. 11A in the wellbore 16. The toolstring 12D uses a timer-activated, battery-powered anchoring device 310 on the toolstring 12D with a single side-arm 312 that deploys to anchor the toolstring 12D in place against the casing 40 of the wellbore 16. Before running into the wellbore 16, the timer device 322 is set to activate after allowing sufficient time for the cable 18 to run into the wellbore 16 to the desired location. The cable 18 and the toolstring 12D are lowered into the wellbore 16 on a cable 18, initially by gravity. A tractor device 290 attached to the toolstring 12D is used to continue running the toolstring 12D into the wellbore 16 in substantially horizontal portions of the wellbore 16. Once the toolstring 12D is in place in the desired location, the timer device 322 activates the switch 318. Activating the switch 318 causes the drive wheels 294 of the tractor device 290 to retract and the anchoring device 310 to activate. The side-arm 312 of the anchoring device 310 swings outward to wedge the toolstring 12D in place against the casing 40 of the wellbore 16.

Figure 12:
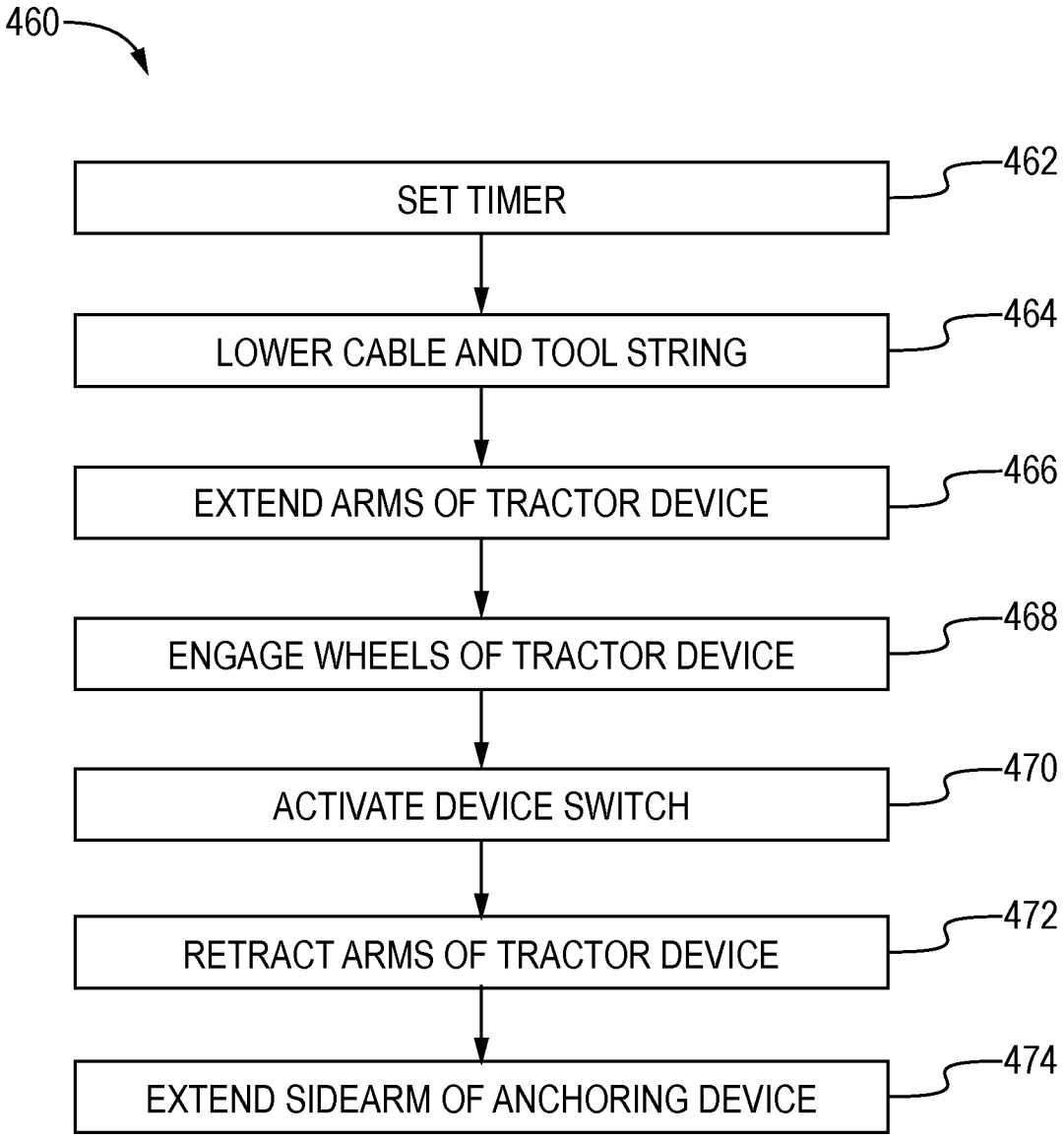
FIG. 12 is a flow chart for a method for lowering the toolstring and holding the cable against the casing of the wellbore using a timer device, in accordance with an aspect of the present disclosure.

FIG. 12 illustrates a flowchart of a method 460 for improving the signal to noise ratio. The method 460 includes setting (block 462) the timer device 322 of the anchoring device 310. The method 460 includes lowering (block 464) the cable 18 and the toolstring 12 into the wellbore 16, initially by gravity. The method 460 includes extending (block 466) the arms 292 of the tractor device 290. The method 460 includes engaging (block 468) the drive wheels 294 of the tractor device 290. The drive wheels 294 may be engaged against a surface of the wellbore 16, thereby driving the toolstring 12 deeper into the wellbore 16. The method 460 includes activating (block 470) the switch 318 of the timer-activated anchoring device 310. The method 460 includes retracting (block 472) the arms 292 of the tractor device 290. The method 460 includes extending (block 474) the side-arm 312 of the anchoring device 310. Extending the side-arm 312 wedges the toolstring 12 against the casing 40 of the wellbore 16.

Similarly to what has been described in relationship with FIG. 8A-C, the anchoring device may not be disposed in the toolstring but may be disposed around the cable in an device independent from the toolstring having a through cavity for receiving the cable so that the cable extends on each side of the device, exiting the device at both extremities of the cavity.

FIGS. 13A-D represent another embodiment of a electromagnetic device according to the disclosure, constituting an alternative of the magnetic device shown on FIG. 8A. The electromagnetic device comprises two half-shells 502A, 502B each comprising a body 504A, 504B and a lid 506A, 506B. Each half shell has a recess 508, here a hollow half-cylinder, on an internal surface of the half-shell to receive the cable. The electromagnetic device also comprises an hinge 510 for connecting the half-shells together, allowing one half-shell to move relative to the other. The half-shells 502A, 502B are connected by the hinge 510 so that in a first open position the half-shells are spread apart allowing access to each of the recesses 508 and, in a second position, the recesses 508 of both half shells 502A, 502B form a cylindrical cavity to receive the cable 18. Each recess 508 extends on the whole length of the half shell along its longitudinal axis so that the cavity is a through cavity when the magnetic device is in the closed position, allowing the cable to extend on each side of the device. The cavity may form a cylinder extending along a linear axis as on FIG. 13A-B. In an embodiment shown on FIG. 13C, the cavity may form a cylinder extending along a sinusoidal curve to ensure a stronger clamping of the cable, even with the cable having diameter variation, with higher friction generated at locations 514. The body of at least one of the half shell 502A, 502B comprise one or more pockets 516 opening on a lateral surface of the body to receive one or more permanent magnet 518 so that the magnets are positioned close to the external surface of the magnetic device. In the embodiment shown in FIG. 13A each half-shell 502A, 502B includes four permanent magnets so that the permanent magnets are regularly distributed around the entire periphery of the electromagnetic device. The electromagnetic device may therefore be attached on any wall of the borehole, does not need to have its position monitored when installed on the cable and can enable a coupling with the borehole wall even if the cable has twisted in the borehole. To ensure higher magnetic coupling, the permanent magnets 518 include a magnetic pole turned toward the external surface of the device and the magnets of each pair of adjacent magnet are configured to have opposite magnetic poles facing the borehole wall 16. The lid 506A, 506B of each half shell is arranged to close the pockets 516, the lid being attached to the corresponding body 504A, 504B via any possible means, in particular a removable connection such as a plurality of screws 520 as represented on FIG. 13B. In the closed position, the half shells may be attached together via a removable connection such as a screw 522. The electromagnetic device may have an hexagonal axial cross-section when in closed position.

Figure 13A:
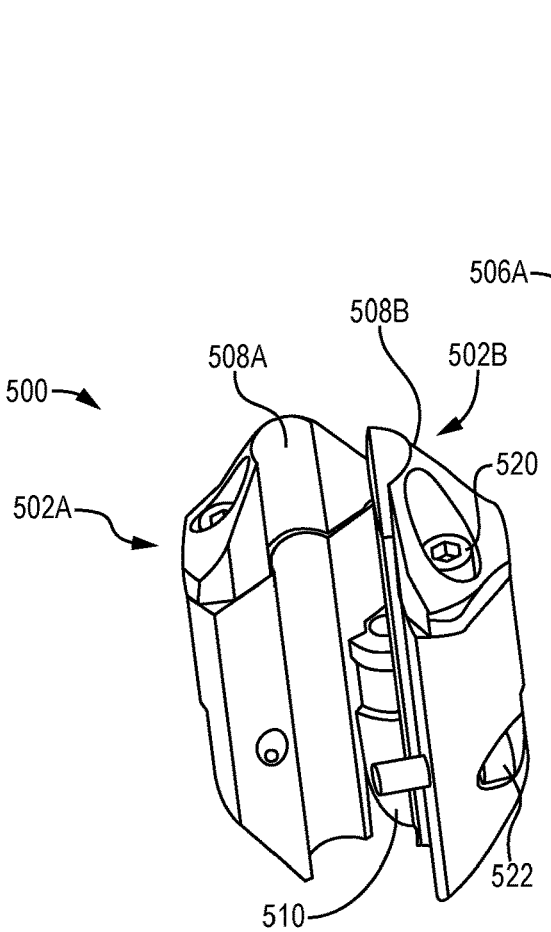
FIG. 13A is a perspective view of a coupling device according to an embodiment of the disclosure.
Figure 13B:
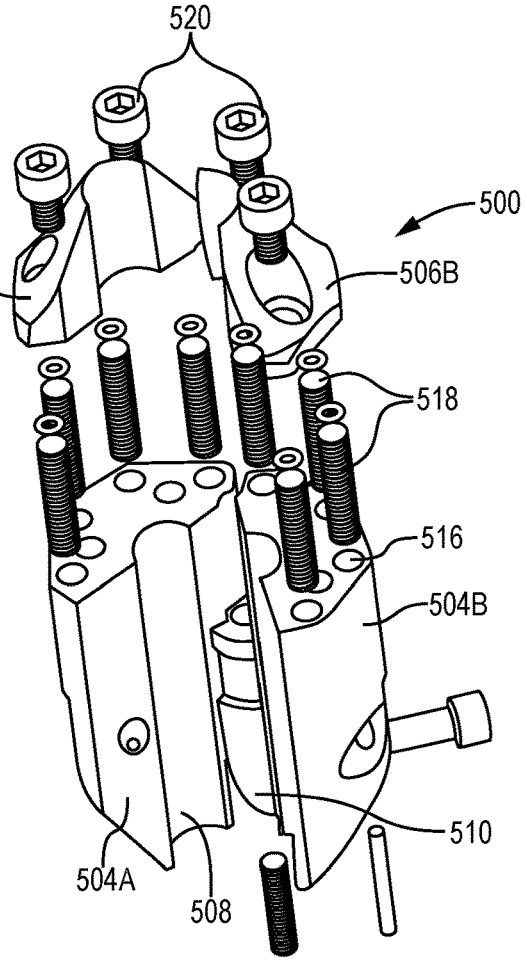
FIG. 13B is an exploded view of the coupling device of FIG. 13A
Figure 13C:
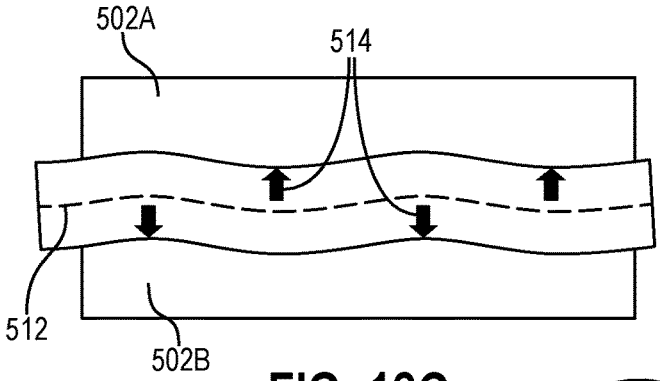
FIG. 13C is a cross-section of a variant of the coupling device of FIG. 13A
Figure 13D:
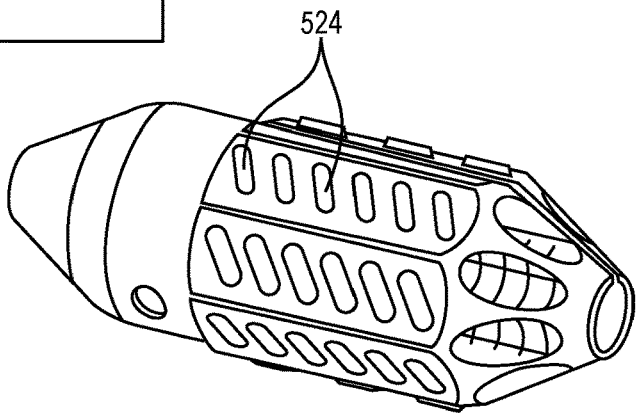
FIG. 13D is a perspective view of another variant of the coupling device of FIG. 13A

In an embodiment shown on FIG. 13D, the electromagnetic device comprises on its external surface a wear resistant device. The wear resistant device may comprise a plurality of wear resistant inserts 524, for instance made of diamond, arranged on the external surface of the magnetic device, for instance on each face of the hexagone. The arrangement of the wear resistant inserts may comprise as on FIG. 13D wear resistant inserts arranged in parallel so as to form an non-zero angle with the longitudinal axis of the cable (and cavity). Alternatively, other configurations may be possible such as inserts positioned parallel to the longitudinal axis of the cable or not parallel to each other. A wear resistant sleeve may also be arranged around the external surface of the magnetic device as well as wear resistant stripes extending along a face of the body of the magnetic device. Such wear resistant device enable to limit the wear of the magnetic device when the cable moves into the borehole of out of the borehole generating frictional contact between the electromagnetic device and the borehole wall for long distances and enables the electromagnetic devices to have a longer life and to be reused on a higher number of jobs.

Many other variants of the embodiment of FIG. 13, for instance a device with any number of magnets or any external shape (for instance, cylindrical, octagonal, etc.) are part of the disclosure.

Figure 14:
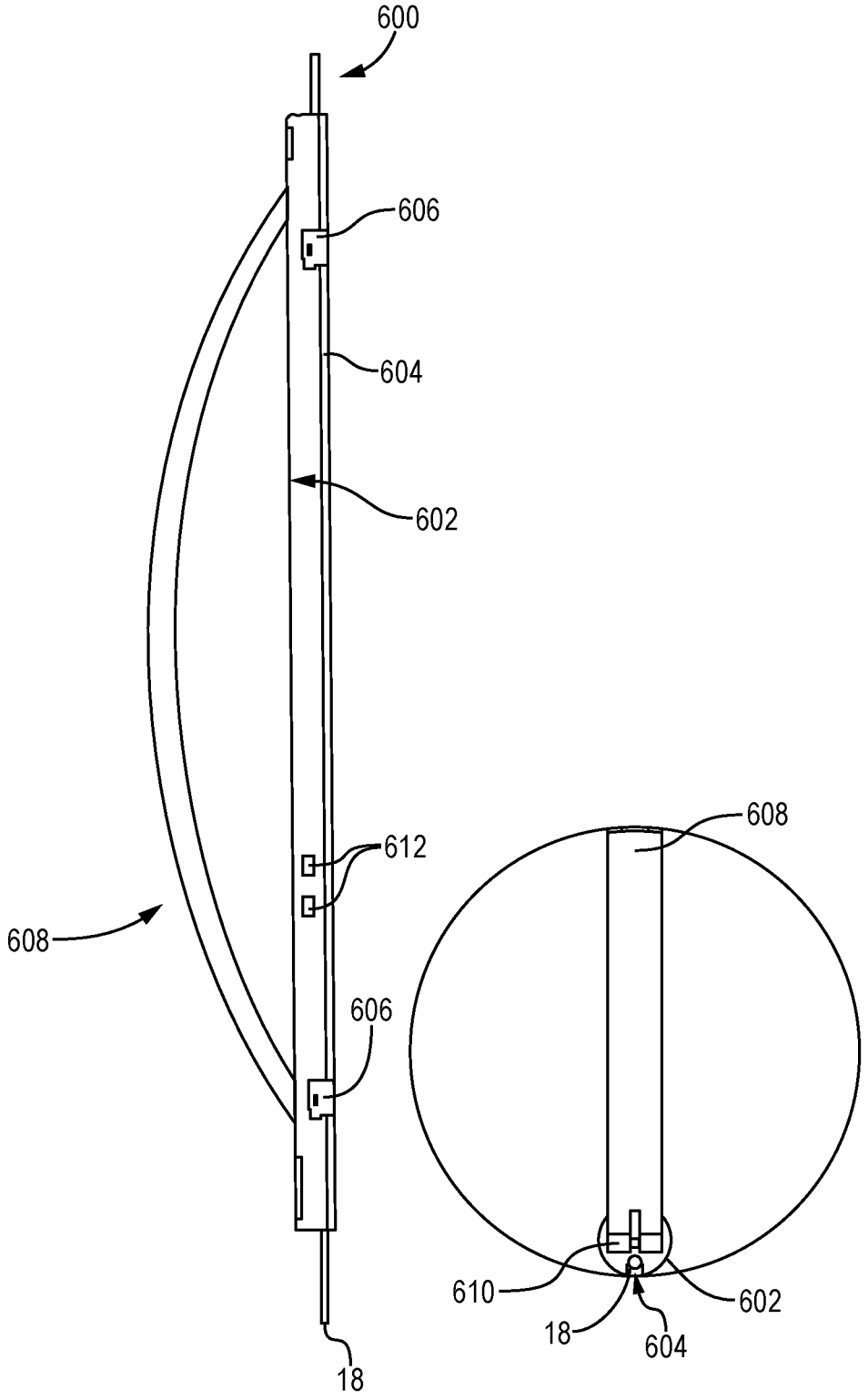
FIG. 14 is a view of a system according to an embodiment of the disclosure

FIG. 14 represents another device 600 for coupling the wireline cable to a borehole wall, either in cased hole or open hole applications. Such device comprises a chassis 602 comprising a cavity 604 for receiving a wireline cable 18. The cavity 604 is a through cavity configured so that its longitudinal axis extends along the longitudinal axis of the chassis 602 on the entire length of the sleeve so that the cable can exit the chassis 602 at both longitudinal ends. It comprises an opening arranged on an external surface of the chassis 602 along a longitudinal axis of the chassis 602. The chassis 602 may also comprises elements to maintain the cable within the cavity such as a connection device 606 for closing the opening of the cavity by connecting the chassis 602 on each side of the opening. Such connection is releasable to enable placement of the cable in the cavity and removal of the cable from the cavity. Gripping members such as restriction compressing the cable may be placed in the cavity, for instance at its longitudinal extremity to avoid that the chassis 602 slides along the cable when passing in front of a restriction. The gripping members may comprise a elastomer portion configured to contact the cable. Alternatively, the connecting elements may include the gripping members. In this case, the connecting elements may energize the elastomer portion of the gripping members when torqued onto the body in order to block the cable in the cavity.

The device also comprises a tool bias mechanism 608 for urging the cavity of the sleeve and therefore the cable against the borehole wall. The tool bias mechanism is therefore arranged on a opposite lateral surface of the chassis 602 relative to the cavity 604. The tool bias mechanism in this embodiment is a bow spring, i.e. a curved metal strip having ends coupled to opposite extremities of the chassis 602 via respective joints 610. The joints 610 can be implemented in any number of ways. In one embodiment, the joints 610 allow pivoting and sliding of the bow spring ends relative to chassis 602. In one embodiment, a first joint includes mating pin and hole, and a second joint a includes mating pin and slot. The mating pin and hole at first joint a allow pivoting of the bow spring end relative to the chassis 602. The mating pin and slot at second joint a allow pivoting and sliding of the bow spring end relative to the chassis 602. Thus, the bow spring can expand and contract as the cable is lowered in the borehole. The force of the bow spring is designed to hold the entire chassis 602 against a side of the borehole.

The coupling device may be instrumented and comprise one or more sensors 612, for instance for determining orientation and/or position of the coupling device 600 and the cable 18. This will enable to derive more accurate information relative to the formation as the position of cable, and fiber if any, is known more precisely. The sensor 612 may for instance include a geophone, a magnetometer or an accelerometer. The one or more sensors may be MEMS (Micro-Electrico-Mechanical Systems) in order to limit the size of the sensor and therefore of the coupling device. Such coupling device may also comprise a battery in order to operate the sensors autonomously. Such sensor 612 may of course be included in any other coupling device, for instance the one described in FIG. 13 or 15.

Many variants of such coupling device are also part of the current disclosure. For instance, the chassis 602 may comprises wear inserts as described in relationship with FIG. 13, in particular in the neighbourhood of the opening of the cavity 604, that is likely to contact the borehole wall. The shape of the chassis may also be different from what has been described.

Figure 15:
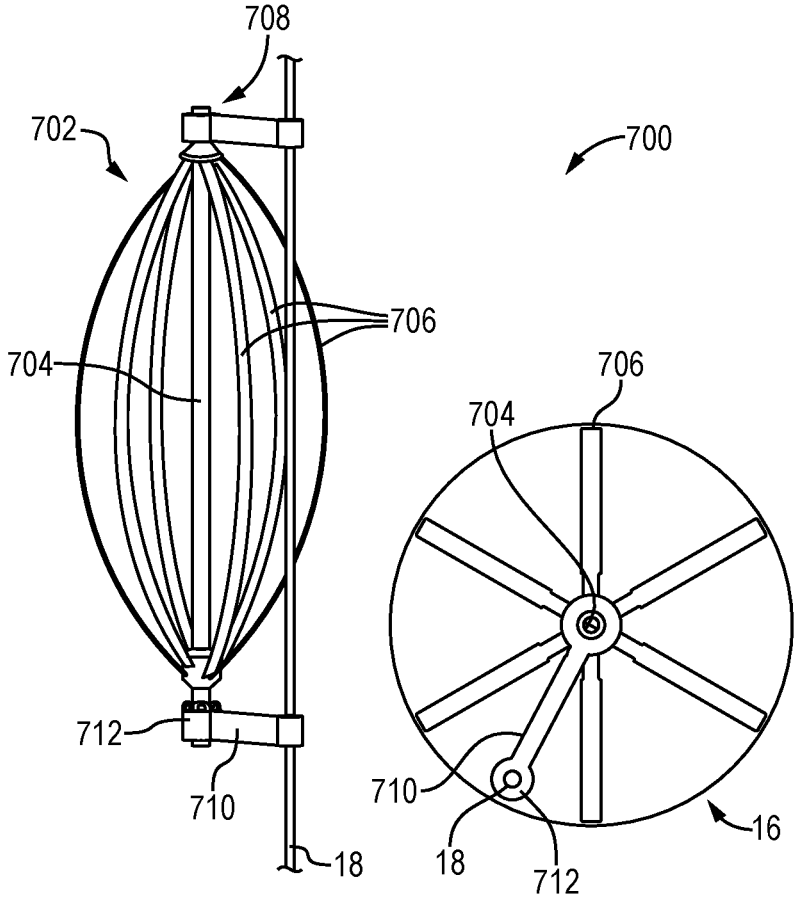
FIG. 15 is a view of a system according to an embodiment of the disclosure

In another embodiment shown on FIG. 15, also applicable to either cased hole or open hole application, the device 700 includes a centralizer 702 having a central element 704 extending longitudinally and a plurality of centralizing members 706 distributed regularly around the central element 704. Each member 706 of the centralizer includes a bow spring as disclosed in relationship with FIG. 14, having its ends arranged at the extremities of the central element. Such centralizer 702 enables the central element to be centered in the borehole 16. It is assumed that having an element centralized in the well indeed enables to have a better coupling in case of wellbore ovality.

Figure 16:
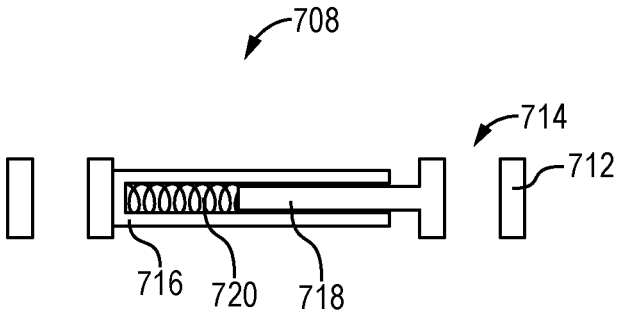
FIG. 16 is a cross-section of a portion of the system of FIG. 15.

The device 700 also includes on a spacer 708 to keep the wireline cable away from the center of the borehole 16. It comprises a plurality of arms 710, each extending at an extremity of the centralizer 702 perpendicularly from the central element of the centralizer and having a gripping member 712 at the longitudinal end of the arm to grip the cable, including a cavity 714 to receive the cable. The spacer 708 is configured so that the cable 18 extends between the gripping member 712 in a direction parallel to the longitudinal axis of the central element. Therefore the longitudinal axis of both arms 710 are disposed in a same plane comprising as well the central axis of the centralizer. The cavity 714 for receiving the cable has a cylindrical shape and configured to have a longitudinal axis parallel to the central element axis. The gripping member 712 grips the cable so that it cannot slide relative to the gripping members. It may be configured to constrain the cable in compression for instance. It may comprise any appropriate design to be able to releasably grip the cable, for instance comprise two portions that are releasably connected to each other and form a cavity having a closed section when connected but opening an access to a portion of the cavity when not connected. The arms 710 of the spacer may also comprise, as represented on FIG. 16, a first portion 716 attached to the centralizer 702 and a second portion 718 attached to the cavity 714 and able to translate along the longitudinal axis of the arm 710 relative to the first portion. The arm includes a spring 720 energized in the borehole radial direction in order to urge the second portion against the borehole wall and to keep the cable constantly in contact with the borehole wall. Spring stiffness is to be set at max equivalent to the radial stiffness of the centralizer bow springs so that it does not interfere with the centralizing function. Such design enables to vary the distance between the centralizer and the cable when the centralizer passes in a restriction while keeping the cable close to the borehole wall.

Figure 17:
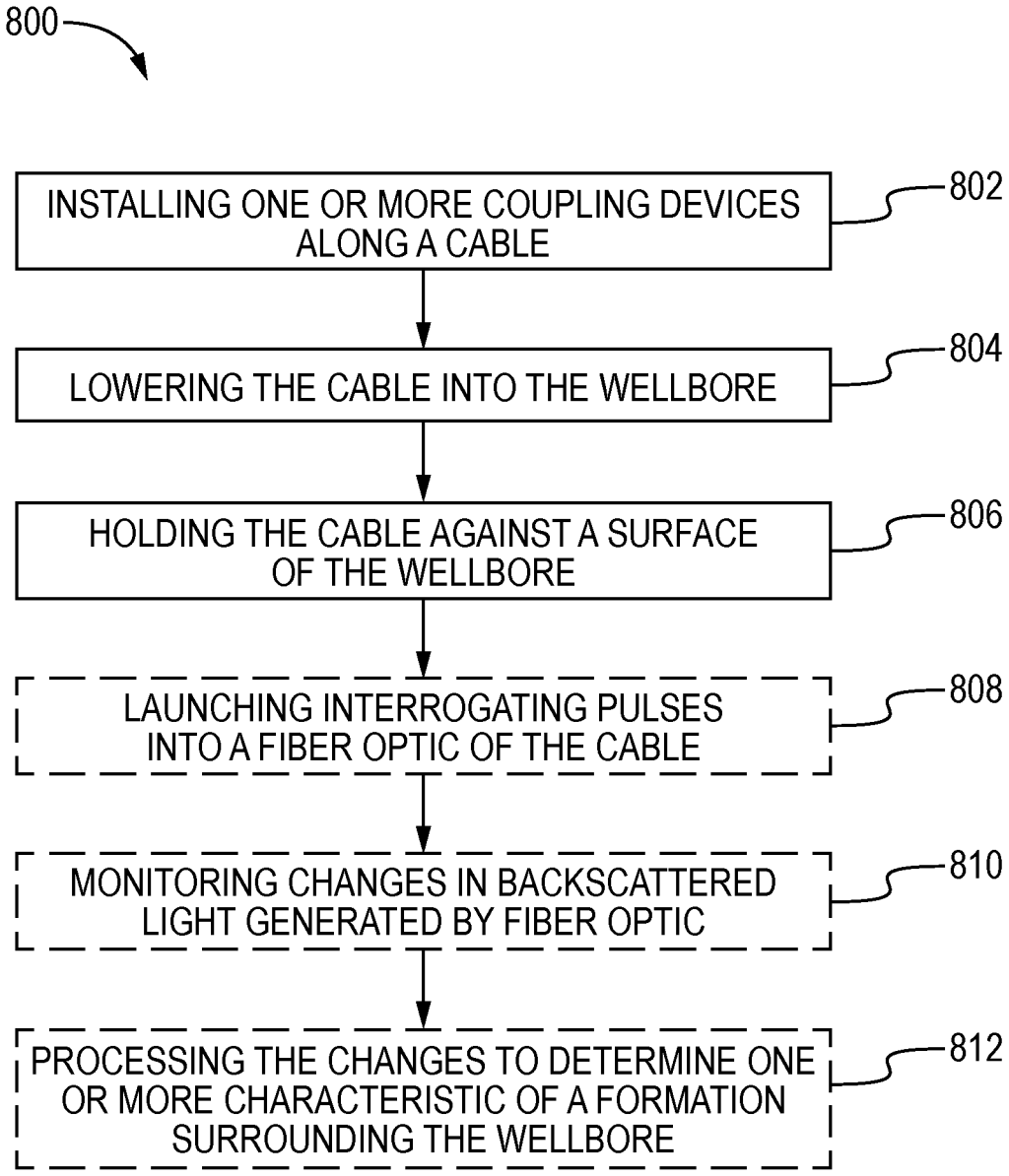
FIG. 17 is a flowchart of a method according to an embodiment of the disclosure.

The disclosure also relates to a method 800 explained in relationship with FIG. 17. The method includes installing one or more coupling devices on the cable 18, generally at the surface (block 802). The coupling devices are installed so that the cable is received in the through cavity of the coupling device and exits the coupling device at both extremities of the cavity. The coupling devices may for instance be installed between the winch (once the cable is unwound) and the wellbore in particular after the cable has passed on the pulleys that may be seen on FIG. 1A. The method then includes lowering the cable (and the coupling devices installed onto it) into the wellbore (block 804). The method also includes holding the cable against a surface of the wellbore (block 806). In some embodiments such operation is triggered by a signal or a timer but with the devices described on FIG. 13-16, this operation is performed just as a consequence of including the devices into the borehole as all of them operate through passive forces (magnetic or elastic). When the cable includes a fiber optic cable, the method may also include performing a distributed measurement ie launching interrogating pulses in the fiber optic (block 808), monitoring changes in backscattered light generated by the fiber optic (block 810) and processing the changes to determine one or more characteristic of the formation (block 812).

With the foregoing in mind, embodiments presented herein provide devices that are capable of improving the signal to noise ratio of measurements. First, a device may aid in propelling a toolstring to the desired location within the wellbore. Once the toolstring has reached the desired location, another device may be utilized to hold the toolstring steady and in place. Keeping the toolstring steady enables sensors to make more accurate measurements by improving the signal to noise ratio of measurements (e.g., by pressing the toolstring against the wellbore wall and/or by maintaining a taut cable that can transmit fiber optic signals with fewer turns or kinks).

With the foregoing in mind, embodiments presented herein provide devices that are capable of improving the signal to noise ratio of measurements. A system according to the disclosure may aid in keeping a cable, in particular having a fiber optic cable, positioned as close as possible to the formation. The coupling of the cable with the borehole wall may be enabled in various ways. It may be beneficial in particular when used in combination with a DAS system sensing one or more parameters of the formation.

The specific embodiments described above have been shown by way of example, and it should be understood that these embodiments may be susceptible to various modifications and alternative forms. For instance, some features disclosed in relationship with one of the coupling device may be arranged on another type of coupling device. For instance, the wear resistant inserts may be arranged and/or sensors may be embarked on any type of coupling.

It should be further understood that the claims are not intended to be limited to the particular forms disclosed, but rather to cover all modifications, equivalents, and alternatives falling within the spirit and scope of this disclosure.

The disclosure generally relates to a system comprising a cable and at least one coupling device installed along the cable having one or more through cavities for receiving the cable, and configured to hold the cable when disposed in the cavity against a surface of the wellbore. Such coupling device may hold the cable against the surface of the wellbore in a cased hole and/or open hole configuration.

In an embodiment, the coupling device comprises an electromagnetic device, such as a permanent magnet or electromagnet. In particular, the electromagnetic device may comprise a plurality of magnets distributed within the coupling device. In a particular embodiment, each magnet is disposed so as to have a predetermined magnetic pole facing an external surface of the device, wherein magnets of each pair of adjacent magnets are disposed so that they have opposite magnetic poles facing the external surface.

In another embodiment, the at least one coupling device comprises a mechanism for pushing the device away from a first location of the borehole wall and urging the cable against a second opposite location of the borehole wall. The mechanism may comprise an anchoring device having a deployable arm or one or more bow springs.

In another embodiment, the coupling device comprises a centralizer, having a central element and a plurality of members disposed around the central element configured to contact the borehole wall and keep the central element at the center of the borehole, and one or more spacers for keeping the cable away from the center element. The one or more members may for instance be bow springs.

In such embodiment, the spacer may be configured so that the distance between the cavity and the central element is variable. It may comprise at least an arm having a longitudinal axis perpendicular to the central element having a first portion attached to the central element and a second portion attached to the cavity. The second portion may be able to translate relative to the first portion along the longitudinal axis between a first position closer to the central element and a second position further from the central element. A spring may be energized to urge the second portion in the second position.

The cable may be a wireline cable and/or may comprise a fiber optic cable. When the cable includes a fiber optic cable, the system may include an interrogation and acquisition system having an optical source for launching interrogating pulses into the fiber optic cable and a detector monitoring the changes in backscatter light generated by the fiber optic cable in response to the interrogating pulses.

In an embodiment, the system comprises a plurality of coupling devices installed around the cable at different locations of the cable.

The coupling device may also be configured so that the cable is immobilized in the cavity. It can also be configured to be releasably installed on the cable.

In an embodiment, the coupling device includes one or more sensors, in particular an accelerometer and/or a magnetometer and/or a geophone. Such sensors may for instance be powered by a battery installed in the coupling device. Such coupling device may be of any type disclosed above.

The disclosure also related to a method for operating a cable in a wellbore. The method includes installing one or more coupling devices along the cable, so that the cable is received in one or more through cavities of the coupling devices, lowering the cable with the installed coupling device into the wellbore, wherein the coupling device holds the cable disposed in the cavity against a surface of the wellbore.

In a particular embodiment of the method, when the cable e includes a fiber optic cable, the method may include launching interrogating pulses into the fiber optic cable with an optical source, monitoring changes in backscatter light generated by the fiber optic cable in response to the interrogating pulses with a detector, and processing the changes to determine one or more characteristic of a formation surrounding the wellbore.

The disclosure also relates to a system comprising a cable; and a toolstring configured to be coupled to the cable, wherein the toolstring is configured to be placed in a wellbore, wherein the toolstring comprises a sensor configured to obtain measurements within the wellbore. The cable or the toolstring, or both, comprise an electromagnetic device or an anchoring device, or both, configured to selectively hold the toolstring or the cable, or both, against a surface of the wellbore.

The electromagnetic device may be coupled directly to the toolstring.

The electromagnetic device may powered by a battery. Alternatively, the electromagnetic device is powered by the cable.

In an embodiment, the electromagnetic device is activated by a timer device.

The toolstring may comprise a tractor device.

The system may comprise an anchoring device. The anchoring device may be coupled directly to the toolstring. The anchoring device may be powered by a battery. It may be timer activated and/or activated by a program and/or by telemetry signals.

The disclosure also generally relates to a cable system comprising a cable core comprising a fiber optic cable; a plurality of strength members outside of the cable core; and a plurality of magnetic strength members outside of the cable core. The plurality of magnetic strength members may be configured to selectively carry current, and the plurality of magnetic strength members may be configured to become magnetic or activate an electromagnet electrically coupled to the plurality of magnetic strength members when the plurality of magnetic strength members carry current, thereby enabling the cable, when placed into a cased wellbore, to attract to a casing of the wellbore and reduce an attenuation of a signal carried by the fiber optic cable by reducing turns or kinks in the cable.

In an embodiment, the plurality of magnetic strength members are insulated.

In an embodiment, the electromagnet is held in place by spacers.

The disclosure also generally relates to a method for improving a signal to noise ratio of a signal provided over a cable by a toolstring, comprising lowering the cable and the toolstring into a wellbore; extending an at least one arm of a tractor device coupled to the toolstring, wherein the at least one arm comprises a wheel; engaging the wheel of the tractor device against a surface of the wellbore to propel the toolstring and the cable into the wellbore; retracting the at least one arm of the tractor device, wherein retracting the at least one arm disengages the wheel from the surface of the wellbore; and attaching the toolstring to the surface of the wellbore using an electromagnetic device or an anchoring device coupled to the toolstring. The anchoring device may be powered by a battery.

The method may comprise setting a timer before lowering and activating a device switch, wherein activating the device switch attaches the toolstring to the surface of the wellbore.

In an embodiment, supplying power to the electromagnetic device activates the electromagnetic device, wherein activating the electromagnetic device attaches the toolstring to the surface of the wellbore. In particular, the electromagnetic device may be powered by a battery.

The method may also comprise detecting a position of the toolstring with telemetry signals and activating a device switch based on telemetry signals, wherein activating the device switch attaches the toolstring to the surface of the wellbore.

The invention claimed is:

1. A system, comprising:

a cable, wherein the cable comprises a fiber optic cable; and at least one coupling device installed along the cable having one or more through cavities for receiving the cable, and configured to hold the cable when disposed in the cavity against a surface of a wellbore, an interrogation and acquisition system having:

an optical source for launching interrogating pulses into the fiber optic cable, a detector monitoring the changes in backscatter light generated by the fiber optic cable in response to the interrogating pulses.

2. The system of claim 1, wherein the at least one coupling device comprising an electromagnetic device.

3. The system of claim 2, wherein the electromagnetic device includes one or more magnets.

4. The system of claim 3, wherein the electromagnetic device comprises a plurality of magnets distributed within the coupling device, wherein each magnet is disposed so as to have a predetermined magnetic pole facing an external surface of the device, wherein magnets of each pair of adjacent magnets are disposed so that they have opposite magnetic poles facing the external surface.

5. The system of claim 1, wherein the at least one coupling device comprises a mechanism for pushing the device away from a first location of the borehole wall and urging the cable against a second opposite location of the borehole wall.

6. The system of claim 5, wherein the mechanism comprises an anchoring device having a deployable arm.

7. The system of claim 5, wherein the mechanism comprises one or more bow springs.

8. The system of claim 1, wherein the at least one coupling device comprises a centralizer, having a central element and a plurality of members disposed around the central element configured to contact the borehole wall and keep the central element at the center of the borehole, and one or more spacers for keeping the cable away from the center element.

9. The system of claim 1, wherein the at least one coupling device comprises one or more wear resistant element on its external surface.

10. The system of claim 1, having an acoustic source for generating an acoustic wave in a formation surrounding the borehole and a processing system for deriving one or more characteristic of the formation based on the monitored changes.

11. The system of claim 1, comprising a plurality of coupling devices installed around the cable at different locations of the cable.

12. The system of claim 1, wherein the coupling device is configured so that the cable is immobilized in the cavity.

13. The system of claim 1, wherein the coupling device is configured to be releasably installed on the cable.

14. The system of claim 1, wherein the coupling device includes one or more sensors.

15. The system of claim 14, wherein the one or more sensors include at least one of an accelerometer, a magnetometer or a geophone.

16. A method for operating a cable in a wellbore, wherein the cable includes a fiber optic cable, including:

installing one or more coupling devices along the cable, so that the cable is received in one or more through cavities of the coupling devices, lowering the cable with the installed coupling device into the wellbore, wherein the coupling device holds the cable disposed in the cavity against a surface of the wellbore, launching interrogating pulses into the fiber optic cable with an optical source monitoring changes in backscatter light generated by the fiber optic cable in response to the interrogating pulses with a detector, processing the changes to determine one or more characteristic of a formation surrounding the wellbore.

17. A system, comprising:

a cable; and at least one coupling device installed along the cable having one or more through cavities for receiving the cable, and configured to hold the cable when disposed in the cavity against a surface of a wellbore, wherein the at least one coupling device comprises a centralizer, having a central element and a plurality of members disposed around the central element configured to contact the borehole wall and keep the central element at the center of the borehole, and one or more spacers for keeping the cable away from the center element.

18. The system of claim 17, wherein the one or more members are bow springs.

19. The system of claim 17, wherein the spacer is configured so that the distance between the cavity and the central element is variable.

20. The system of claim 19, wherein the spacer comprises at least an arm having a longitudinal axis perpendicular to the central element having a first portion attached to the central element and a second portion attached to the cavity, wherein the second portion is able to translate relative to the first portion along the longitudinal axis between a first position closer to the central element and a second position further from the central element and wherein a spring is energized to urge the second portion in the second position.

* * * * *